US011040809B1

(12) United States Patent
Meshberg

(10) Patent No.: US 11,040,809 B1
(45) Date of Patent: Jun. 22, 2021

(54) PUSH BUTTON TILT TOP CLOSURE AND LOCKING SYSTEM FOR A CONTAINER

(71) Applicant: Packaging Concepts Associates Holding, Inc., Torrington, CT (US)

(72) Inventor: Emil Meshberg, Fairfield, CT (US)

(73) Assignee: PACKAGING CONCEPTS ASSOCIATES HOLDING, INC., Torrington, CT (US)

( * ) Notice: Subject to any disclaimer, the term of this patent is extended or adjusted under 35 U.S.C. 154(b) by 0 days.

(21) Appl. No.: 17/067,055

(22) Filed: Oct. 9, 2020

(51) Int. Cl.
*B65D 50/04* (2006.01)
*B65D 47/20* (2006.01)
*B65D 51/24* (2006.01)

(52) U.S. Cl.
CPC ..... *B65D 50/046* (2013.01); *B65D 47/2006* (2013.01); *B65D 51/248* (2013.01); *B65D 2215/02* (2013.01); *B65D 2547/06* (2013.01)

(58) Field of Classification Search
CPC .... B65D 25/48; B65D 50/061; B65D 50/046; B65D 50/045; B65D 50/04; B65D 47/0804; B65D 47/08; B65D 47/2006; B65D 47/20; B65D 51/248; B65D 51/24; B65D 51/04
USPC ..... 215/216, 206, 211, 201, 244, 237, 235; 220/830, 827, 810, 254.3, 254.1; 222/556, 568, 567, 531, 529; 206/536, 206/535, 528
See application file for complete search history.

(56) References Cited

U.S. PATENT DOCUMENTS 3,429,483 A 2/1969 Micallef
3,601,290 A 8/1971 Nigro
3,642,161 A 2/1972 Stroud
3,828,982 A 8/1974 Steigerwald
3,848,778 A 11/1974 Meshberg
(Continued)

FOREIGN PATENT DOCUMENTS

CA 2623265 A1 8/2008
EP 1502871 A2 2/2005
(Continued)

OTHER PUBLICATIONS

Bascousa.com, "Life Latch New Generation 2.5 Gallon Plastic Pail with White Screw Top Lid—White", https://web.archive.org/web/20160624 135556/https://bascousa.com/2.5-gallon-pail-with-screw-top-lid.html, Jun. 24, 2016.
(Continued)

*Primary Examiner* — Robert J Hicks
(74) *Attorney, Agent, or Firm* — Ware, Fressola, Maguire & Barber LLP

(57) ABSTRACT

A child resistant closure and dispenser for a container is provided including a pivoting tilt-top type closure and an automatic locking element comprising a push button that locks the disk top in a closed position. The closure mechanism includes an actuator on the disk surface that can be depressed by the user to pivot the top to expose a dispensing orifice into the container for dispensing the substance. The closure mechanism also includes an opening through a body portion supporting the disk-top, through which a push button extends outwardly and abuts an edge of a wall of a body of the closure mechanism. In order to open the dispenser, the button must be depressed into the opening, to bring the button out of abutment with edge, while pressing down on the actuator.

20 Claims, 16 Drawing Sheets

(56) References Cited

U.S. PATENT DOCUMENTS 3,993,209 A 11/1976 Julian
4,024,988 A 5/1977 Starrett
4,127,221 A * 11/1978 Vere ..... B65D 47/0842 215/214
4,371,095 A * 2/1983 Montgomery ..... B65D 50/045 215/211
4,513,888 A 4/1985 Curry
4,653,672 A 3/1987 Tuerk et al.
4,773,567 A 9/1988 Stoody
4,776,501 A * 10/1988 Ostrowsky ..... B65D 47/2006 215/235
4,821,898 A 4/1989 Smalley
4,838,460 A 6/1989 Moore et al.
4,865,209 A 9/1989 Bush
4,982,882 A * 1/1991 Gueret ..... B65D 47/065 220/254.3
5,040,691 A 8/1991 Hayes et al.
5,192,005 A * 3/1993 Zimmerman ..... B65D 47/046 222/148
5,224,615 A 7/1993 Hickerson
5,277,325 A 1/1994 Yan
5,279,451 A 1/1994 Mueller et al.
5,282,551 A 2/1994 Pierson
5,314,093 A 5/1994 Gross et al.
5,379,924 A 1/1995 Taylor
5,379,926 A 1/1995 Mueller et al.
5,388,730 A 2/1995 Abbott et al.
5,402,900 A 4/1995 Glynn
5,431,293 A 7/1995 Piron
5,458,263 A 10/1995 Ciammitti et al.
5,462,182 A 10/1995 Opresco
5,462,183 A 10/1995 Rohr et al.
5,520,296 A 5/1996 Freed
5,597,083 A 1/1997 Childers et al.
5,622,284 A 4/1997 Sawicki
5,628,627 A 5/1997 Fairbanks et al.
5,702,031 A 12/1997 Meshberg et al.
5,706,962 A 1/1998 Tauber
5,772,080 A 6/1998 de Pous et al.
5,979,681 A 11/1999 Varlet et al.
6,047,856 A 4/2000 Meshberg et al.
6,082,564 A 7/2000 Trout
6,168,035 B1 1/2001 McLelland
6,283,333 B1 9/2001 Knickerbocker et al.
6,691,896 B2 2/2004 Meshberg
6,896,160 B2 5/2005 Kaufman et al.
6,932,244 B2 8/2005 Meshberg
6,971,547 B2 12/2005 Englert et al.
7,168,594 B2 1/2007 Law et al.
7,404,495 B2 * 7/2008 Keung ..... B65D 47/0804 215/216
7,434,707 B2 10/2008 Meshberg
7,530,476 B2 5/2009 Downey et al.
8,002,149 B2 8/2011 Leonard
8,127,968 B2 3/2012 Yerby et al.
8,141,731 B2 3/2012 Mazurkiewicz et al.
8,251,251 B2 8/2012 Arvidsson et al.
8,251,252 B2 8/2012 Giraud
8,267,265 B2 * 9/2012 Giraud ..... B65D 50/045 215/216
8,292,101 B1 10/2012 Bragg et al.
8,322,562 B2 12/2012 Dybala
8,333,288 B2 12/2012 Miller et al.
8,360,258 B2 1/2013 Gilbert et al.
8,434,639 B2 5/2013 Markert
8,453,873 B2 6/2013 Zielinski et al.
8,469,212 B2 * 6/2013 Goto ..... B65D 50/046 215/237
8,579,140 B2 11/2013 Delagrange et al.
8,777,061 B1 * 7/2014 Meshberg ..... B05B 11/3059 222/153.13
8,783,483 B2 * 7/2014 Faragher ..... B65D 47/0838 215/224
9,045,265 B2 6/2015 Adamczak
9,156,597 B2 10/2015 Letica et al.
9,889,976 B2 2/2018 Miller et al.
9,975,670 B2 5/2018 Giraud et al.
10,167,120 B1 1/2019 Levy et al.
10,518,941 B2 12/2019 Jelich
10,518,945 B2 12/2019 Phillips et al.
10,660,463 B2 5/2020 Sims
10,669,082 B1 6/2020 Meshberg et al.
10,689,169 B1 * 6/2020 Meshberg ..... B65D 50/046
2002/0179644 A1 12/2002 Evans et al.
2004/0149787 A1 8/2004 Englert et al.
2007/0119870 A1 5/2007 Lasserre et al.
2007/0164027 A1 7/2007 Auer
2008/0237236 A1 10/2008 Tanner et al.
2010/0127021 A1 3/2010 Schantz et al.
2012/0248129 A1 10/2012 Yoshida et al.
2016/0068317 A1 3/2016 Petit
2017/0066575 A1 3/2017 Leopold
2018/0214894 A1 8/2018 Meshberg
2018/0221601 A1 8/2018 Meshberg
2018/0229903 A1 8/2018 Lee et al.
2018/0346210 A1 12/2018 Jelich
2020/0277112 A1 9/2020 Gift et al.

FOREIGN PATENT DOCUMENTS

EP 2636610 A1 9/2013
WO 9429184 12/1994
WO 9936328 A1 7/1999
WO 0034143 A1 6/2000
WO 0045684 A1 8/2000
WO 0140095 A1 6/2001
WO 2006081928 A1 8/2006
WO 2011022795 A2 3/2011
WO 2018039175 A1 3/2018
WO 2018081383 A1 5/2018
WO 2018128627 A1 7/2018
WO 2019129567 A1 7/2019

OTHER PUBLICATIONS

Amazon.com "Contigo Glass Water Bottle with a Quick-Twist Lid, 20oz, Blue Corn", https://www.amazon.com/Contigo-Glass -Water-Bottle-Quick-Twist/dp/B078D68N1G, Dec. 5, 2017.
Greenrushpackaging.com, 13 Dram translucent child resistant pop-top bottles, Apr. 24, 2019.
Sonya Sing Lee, "Sprinkle Child resistant packaging," http://www.coroflot.com/sonyasinglee/sprinkle-child-resistant-packaging, Jun. 2, 2016.
Design Cognition, "New Child Resistant Spray Pack," http://www.designcognition.com/2010/07/new-child-resistant-spray-pack/, Oct. 21, 2010.
pharmapackagingdesign.com, "Package patent gallery," https://www.pharmapackagingdesign.com/pharmaceutical_package_patents.html, Oct. 23, 2014.

* cited by examiner

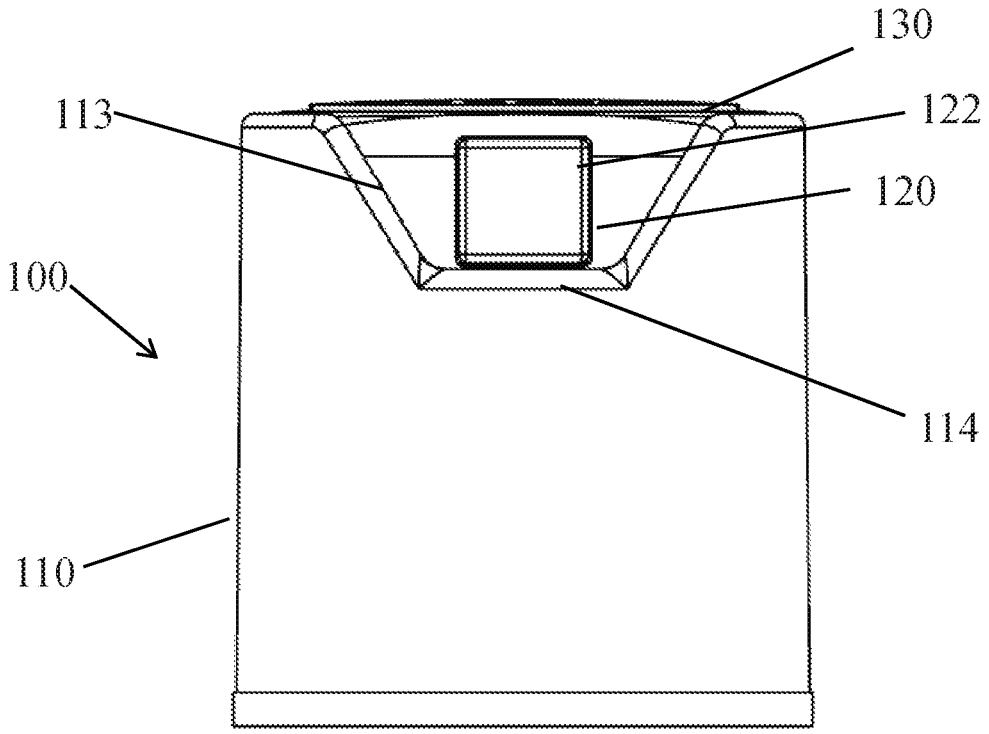
FIG. 1E
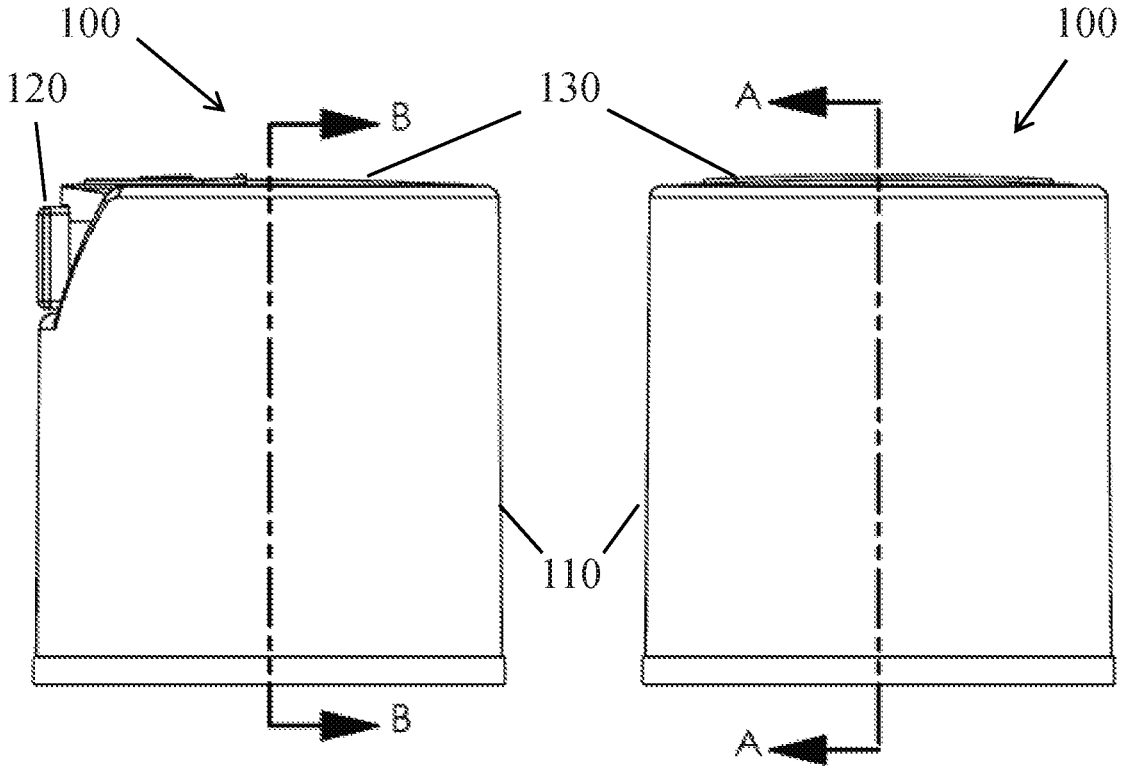
FIG. 1F
FIG. 1G

SECTION A-A

SECTION B-B

SECTION A-A

SECTION B-B

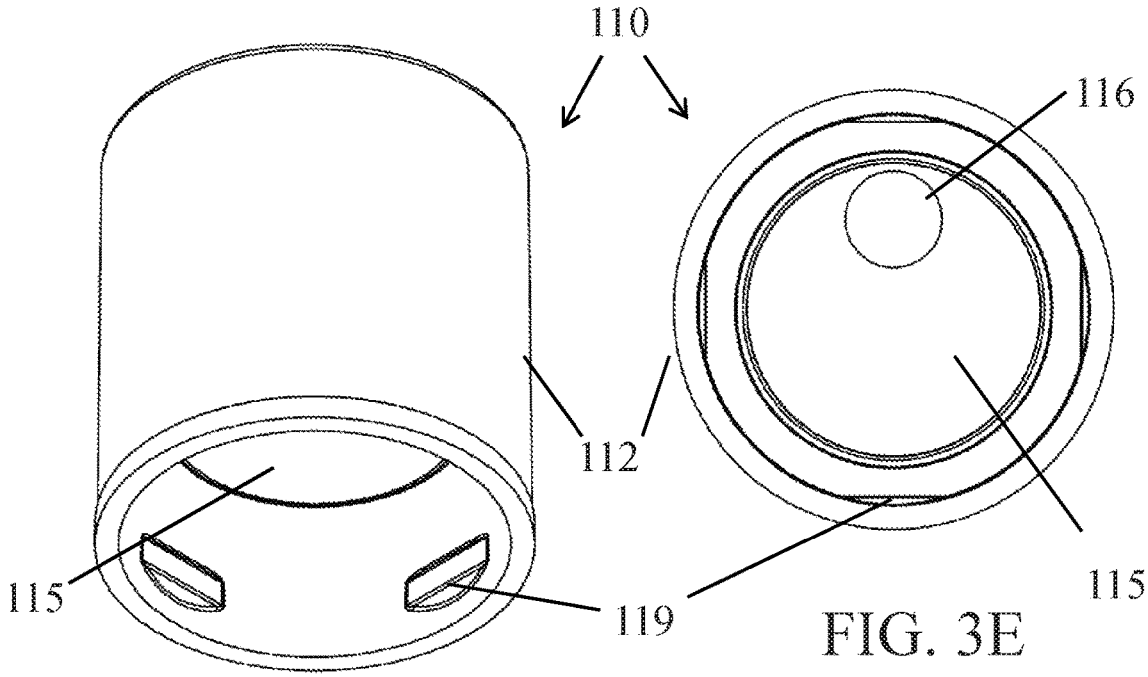
FIG. 3D
FIG. 3E
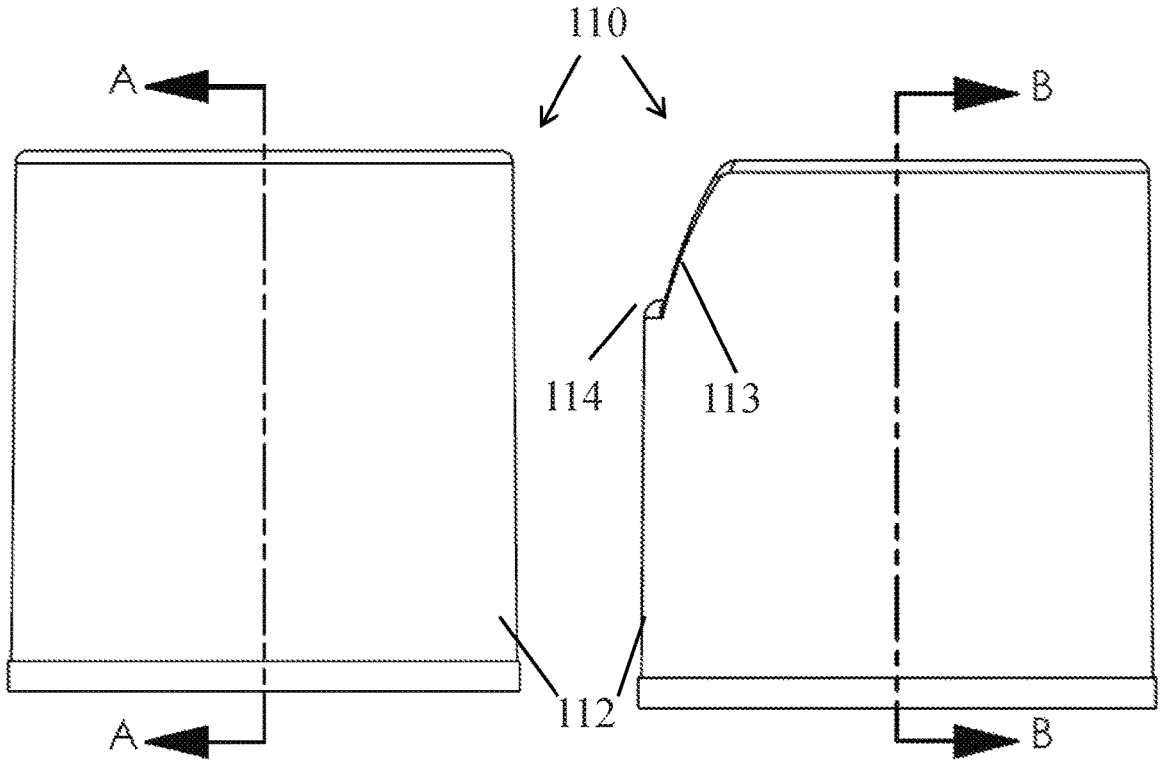
FIG. 3F
FIG. 3G

SECTION A-A

SECTION B-B

SECTION A-A

SECTION B-B

SECTION C-C

PUSH BUTTON TILT TOP CLOSURE AND LOCKING SYSTEM FOR A CONTAINER

FIELD OF THE INVENTION

The present application relates to child-resistant closure and locking device for containers, and in particular, a child-resistant tilt-top closure and push button locking device for a container.

BACKGROUND OF THE INVENTION

A typical standard disk top closure is comprised of two parts, a body and a disk. The main body consists of a closure feature, such as threading or a snap for a container providing a single dispense orifice, which is disposed below the disk. The body provides the structure and disk pivot features, which hold the disk in position to either seal the container orifice, or to be pivoted to the dispense position, which allows the contained product to flow out of the orifice and pass through the disk and out of the dispense port. However, most disk-top closures do not include any child-resistant locking mechanism, or may include a locking mechanism that is overly complicated and too difficult for some elderly users to open. What is needed is a child resistant closure and locking mechanism integrating a disk top that addresses these shortcomings in the art.

SUMMARY OF THE INVENTION

The present application relates to a child resistant ("CR") closure and dispenser for a container, which combines the standard function of a typical pivoting tilt-top type closure, and a CR system which uses an automatic locking element comprising a push button that locks the disk top in a closed position. The closure mechanism includes an actuator on the disk surface that can be depressed by the user to pivot the top to expose a dispensing orifice into the container for dispensing the substance. The closure mechanism also includes an opening through a body portion supporting the disk-top, through which a push button extends outwardly from a central axis of the closure mechanism. The push button is biased outwardly, into the opening and away from a central axis, and when the button extends out from the opening, it prevents the closure mechanism from opening. In this position, a lower edge of the button abuts an edge of a cutout on the main body of the system, preventing the pivoting of the disk-top closure mechanism to expose the dispensing orifice. In order to open the dispenser, the button must be depressed into the opening, to bring the button out of contact with the cutout edge, while pressing down on the actuator. This actuation process may require the use of two hands simultaneously, thus making the system child resistant.

In accordance with a first aspect of the present application, a closure system for a dispensing container is provided comprising a body member and an actuator. The body member comprises an outer circumferential wall comprising a recess in the wall. The actuator comprises a dispensing orifice; a disk top comprising an actuating portion configured to be depressed to pivot the disk top between an open configuration providing access to the dispensing orifice and a closed configuration concealing the dispensing orifice; an actuator wall extending from and around the perimeter of the disk top having the dispensing orifice formed through a first section of the actuator wall and a wall opening formed through a second section of the actuator wall, the wall opening arranged adjacent to the actuating portion; and a push button member arranged within the actuator wall comprising a projecting button biased outwardly through the wall opening. In the closed configuration, the projecting button abuts an edge of the recess of the outer circumferential wall of the body member, which prevents depression of the actuating portion and pivoting of the disk top into the open configuration. The projecting button is configured to be pushed inwardly through the wall opening to position the projecting button out of abutment with the edge of the recess to enable depression of the actuating portion and pivoting of the disk top into the open configuration.

In various embodiments of the closure system of the first aspect of the application, in the open configuration, a portion of the disk top opposite the actuating portion can be depressed to pivot the disk top from the open configuration into the closed configuration, and in the open configuration, the outwardly biased projecting button is retained within the outer circumferential wall of the body member, and pivoting the disk top from the open configuration into the closed configuration enables the outwardly biased projecting button to extend back through the wall opening into abutment with the edge of the recess of the outer circumferential wall of the body member.

Further in accordance with one or more embodiments of the closure system of the first aspect of the application, the body member further comprises two opposing dimples on an inner surface of the outer circumferential wall configured to engage projecting members of the actuator to secure the actuator to the body member in a manner that permits the pivoting of the actuator.

In further embodiments of the closure system of the first aspect of the application, the outer circumferential wall is configured to conceal the dispensing orifice in the closed configuration.

In various embodiments of the closure system of the first aspect of the application, the body member comprises a tubular passageway projecting from a shelf within the body member configured to deliver a substance to the dispensing orifice. The actuator may further comprise a sealing member configured to engage the tubular passageway of the body member in the closed configuration to seal the tubular passageway from the dispensing orifice.

Further, in embodiments of the closure system of the first aspect of the application, the body member comprises a base section configured to be connected to a bottle or a container.

In various embodiments of the closure system of the first aspect of the application, the push button member comprises a spring configured to bias the projecting button outwardly through the wall opening and engaging the actuator at a side of the spring opposite the projecting button. The spring of the push button member may be a flexible ring comprising the push button on one side and a slot on another side opposite the push button. The actuator may further comprise a wall segment within the actuator wall comprising a finger configured to be received in the slot of the push button member to engage the push button member to the actuator. The wall segment of the actuator may comprise a beveled edge adjacent to a tubular passageway within the body member.

In embodiments of the closure system of the first aspect of the application, the actuating portion comprises raised indicia identifying the actuating portion.

In accordance with one or more embodiments of the closure system of the first aspect of the application, the first section of the actuator wall comprising the dispensing orifice is arranged opposite the second section of the actuator wall comprising the wall opening.

In accordance with various embodiments of the closure system of the first aspect of the application, pivoting of the disk top into the open configuration comprises simultaneously pushing inwardly the projecting button to position the projecting button out of abutment with the edge of the recess and depressing the actuating portion of the disk top.

In accordance with a second aspect of the application, a closure system for a dispensing container is provided comprising a body member and an actuator. The body member comprises an outer circumferential wall comprising a recess in the wall. The actuator comprises a dispensing orifice; a disk top comprising an actuating portion configured to be depressed to pivot the disk top between an open configuration providing access to the dispensing orifice and a closed configuration concealing the dispensing orifice; and a push button member comprising a projecting button biased outwardly into the recess of the outer circumferential wall of the body member and arranged adjacent to the actuating portion of the disk top. In the closed configuration, the projecting button abuts an edge of the recess of the outer circumferential wall of the body member, which prevents depression of the actuating portion and pivoting of the disk top into the open configuration. The projecting button is configured to be pushed inwardly to position the projecting button out of abutment with the edge of the recess to enable depression of the actuating portion and pivoting of the disk top into the open configuration. In the open configuration, a portion of the disk top opposite the actuating portion can be depressed to pivot the disk top from the open configuration into the closed configuration, and further in the open configuration, the outwardly biased projecting button is retained within the outer circumferential wall of the body member, and pivoting the disk top from the open configuration into the closed configuration enables the outwardly biased projecting button to extend back into abutment with the edge of the recess of the outer circumferential wall of the body member. The push button member may also comprise a spring configured to bias the projecting button outwardly and engaging the actuator at a side of the spring opposite the projecting button.

In accordance with a third aspect of the application, a system is provided comprising a container for dispensing a substance and a closure system for the container. The closure system includes a body member comprising an outer circumferential wall comprising a recess in the wall. The closure system further comprises an actuator comprising a dispensing orifice, a disk top comprising an actuating portion configured to be depressed to pivot the disk top between an open configuration providing access to the dispensing orifice and a closed configuration concealing the dispensing orifice, an actuator wall extending from and around the perimeter of the disk top having the dispensing orifice formed through a first section of the actuator wall and a wall opening formed through a second section of the actuator wall, the wall opening arranged adjacent to the actuating portion; and a push button member arranged within the actuator wall comprising a projecting button biased outwardly through the wall opening. In the closed configuration, the projecting button abuts an edge of the recess of the outer circumferential wall of the body member, which prevents depression of the actuating portion and pivoting of the disk top into the open configuration. The projecting button is configured to be pushed inwardly through the wall opening to position the projecting button out of abutment with the edge of the recess to enable depression of the actuating portion and pivoting of the disk top into the open configuration. The body member of the closure system may comprise either or both of a base section configured to be connected the container, and an annular seal configured to be received in a neck of the container to seal the container and direct the substance of the container into a tubular passageway configured to deliver the substance to the dispensing orifice.

BRIEF DESCRIPTION OF THE DRAWINGS

FIG. 1E shows a rear view of the container closure and dispensing device in accordance with the first embodiment of the present application, in a locked and closed configuration;

FIG. 1F shows a side view of the container closure and dispensing device in accordance with the first embodiment of the present application, in a locked and closed configuration;

FIG. 1G shows a front view of the container closure and dispensing device in accordance with the first embodiment of the present application, in a locked and closed configuration;

FIGS. 3A-3D show various perspective views of a body section of the container closure and dispensing device in accordance with the first embodiment of the present application;

FIG. 3E shows a bottom view of the body section of the container closure and dispensing device in accordance with the first embodiment of the present application, in an unlocked and open configuration;

FIG. 3F shows a front view of the container closure and dispensing device in accordance with the first embodiment of the present application, in an unlocked and open configuration;

FIG. 3G shows a side view of the container closure and dispensing device in accordance with the first embodiment of the present application, in an unlocked and open configuration;

DETAILED DESCRIPTION OF THE INVENTION

Figure 1A:
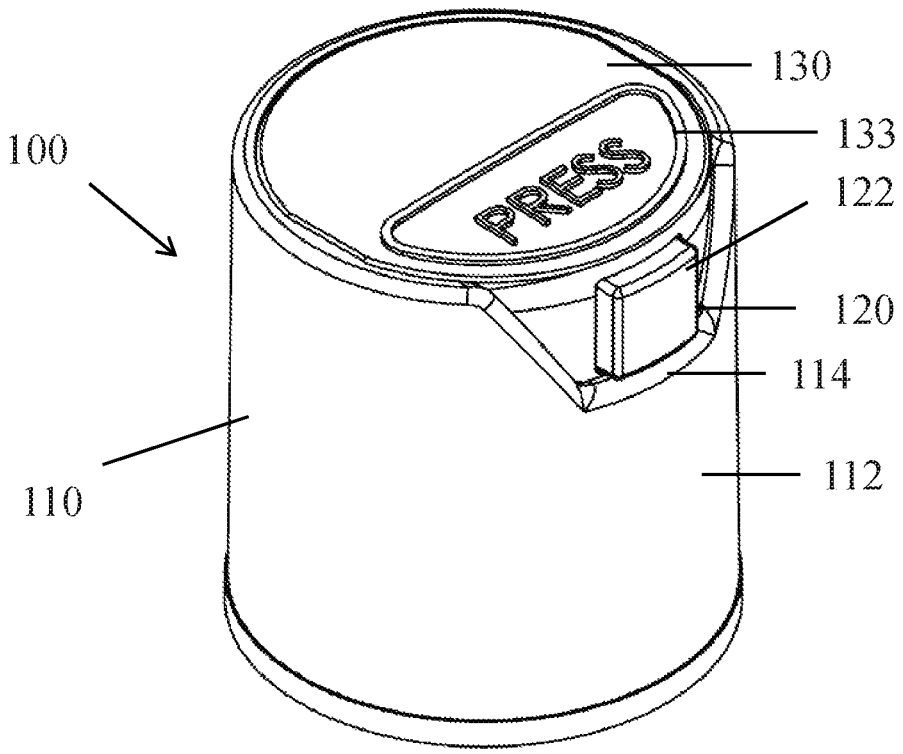
FIG. 1A shows a rear perspective view of a container closure and dispensing device in accordance with a first embodiment of the present application, in a locked and closed configuration.
Figure 1B:
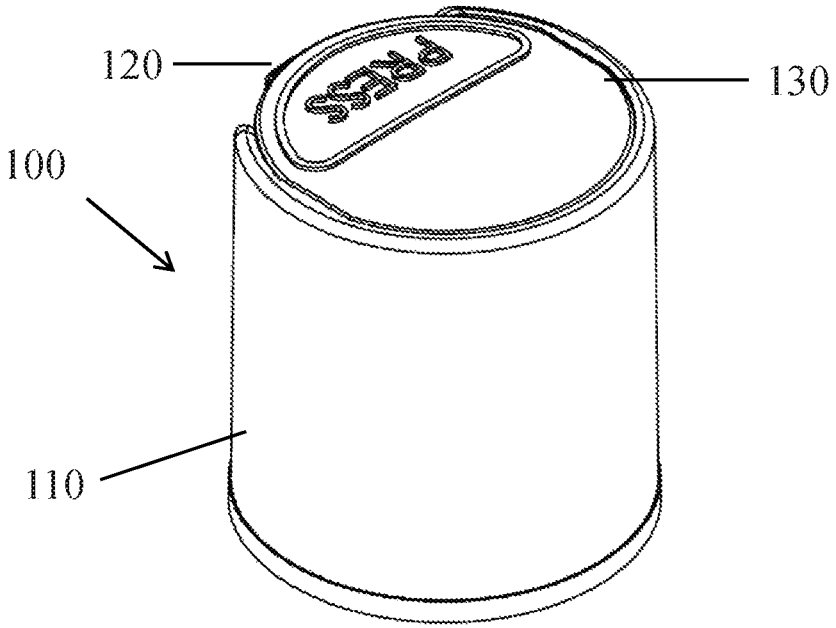
FIG. 1B shows a front perspective view of the container closure and dispensing device in accordance with the first embodiment of the present application, in a locked and closed configuration.
Figure 1C:
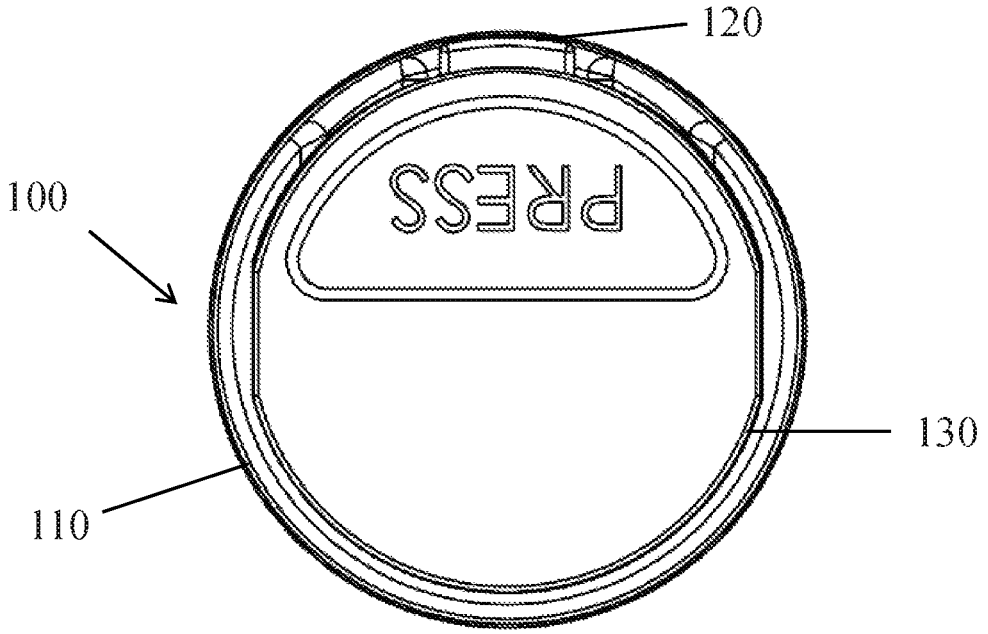
FIG. 1C shows a top view of the container closure and dispensing device in accordance with the first embodiment of the present application, in a locked and closed configuration.
Figure 1D:
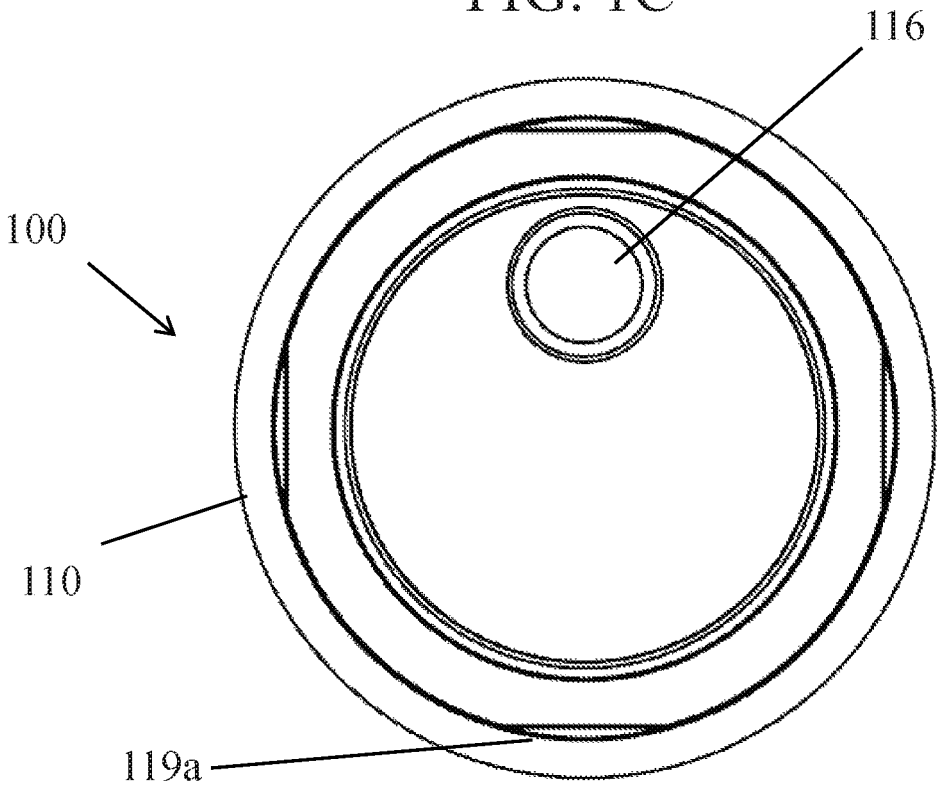
FIG. 1D shows a bottom view of the container closure and dispensing device in accordance with the first embodiment of the present application, in a locked and closed configuration.
Figure 1H:
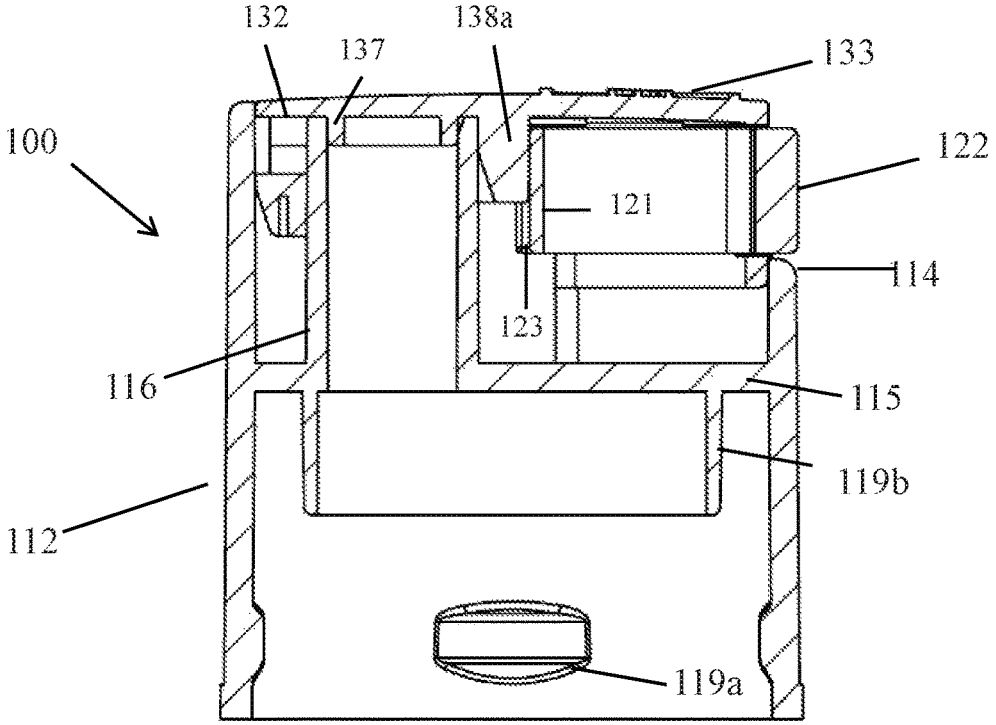
FIG. 1H shows a cross-sectional view of the container closure and dispensing device in accordance with the first embodiment of the present application, in a locked and closed configuration, along axis A-A identified in FIG. 1G.
Figure 1I:
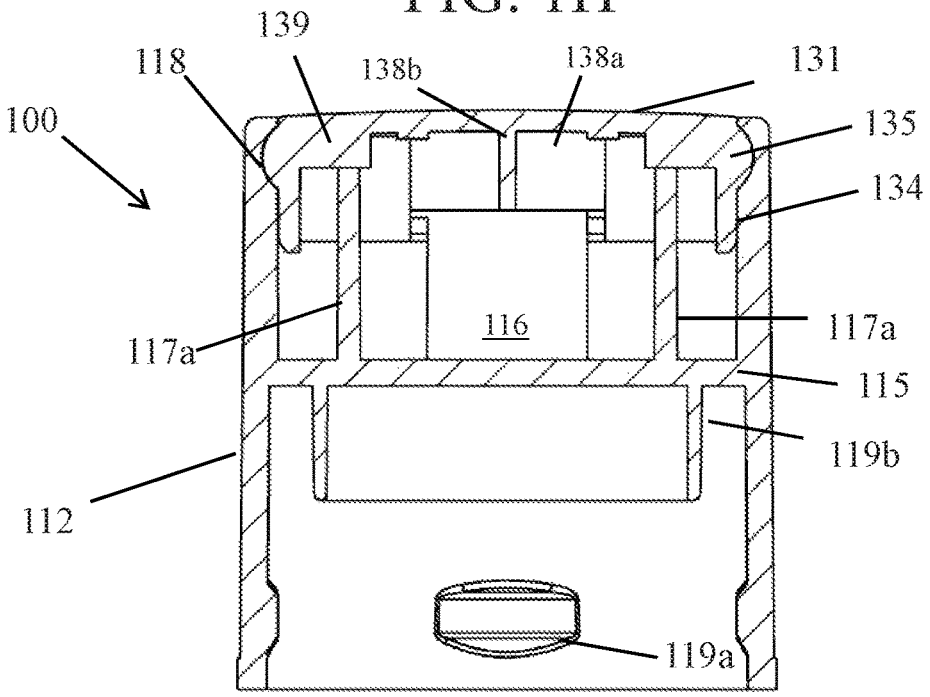
FIG. 1I shows a cross-sectional view of the container closure and dispensing device in accordance with the first embodiment of the present application, in a locked and closed configuration, along axis B-B identified in FIG. 1F.

The container closure system of the present application will be described with reference to FIGS. 1A-5K.

A child resistant ("CR"), push button tilt top closure and dispensing system 100 in accordance with the present application combines a disk top closure for a container with a push button CR system, which uses an automatic locking element and requires a simultaneous actuation of a button while depressing an actuator to move the container closure from a dispense-disabled position, to a dispense-enabled position. The CR flip top closure system 100 comprises a main body section 110, a push button member 120 and a pivotable actuator 130.

The main body 110 acts as a means of attachment of the closure system 100 to a container or a bottle (not shown) storing a substance to be dispensed. The main body 110 includes an open top section 111, into which the actuator 130 and button member 120 can be inserted and secured to the main body 110. The main body 110 further includes an outer circumferential wall 112. Along the top of the outer circumferential wall 112, the wall 112 includes a recess 113 cutout of the outer wall 112, which comprises an edge 114 along the bottom of the recess 113.

The main body 110 includes an open bottom, such that the outer wall 112 at the base of the main body 110 is dimensioned to fit over a neck of the bottle or container, and to engage the neck of the bottle or container. In the embodiment illustrated in the Figures, one or more locking elements 119*a* are arranged within the base of the outer wall 112 that may snap over and engage a circumferential bead on the neck of the bottle or container. However, the main body section 110 can be secured to the bottle or container using alternative mechanisms, including for example with internal threading inside the outer wall 112 to engage a threaded neck on the bottle or container, which may further comprises locking teeth on the bottom of a screw thread that "lock" with corresponding teeth on the shoulder of the bottle or container, or floating teeth, wherein one must push down on the closure system 100 in order to engage the teeth on bottom of a screw thread with corresponding teeth on shoulder of the bottle or container.

In between the open top section 111 and the base of the main body 110, a shelf 115 is provided in the form of a substantially flat disk-like surface. On the undersurface of the shelf 115 (facing the base of the main body 110), an annular seal 119*b* is provided. The annular seal 119*b* is configured to fit inside of the neck of the bottle or container to provide prevent leakage of the substance from the bottle or container out of the open base of the main body 110. An opening is formed through the shelf 115 that extends through a tubular passage 116 projecting from the upper surface of the shelf 115. The passage 116 is in fluidic communication with the container or bottle through the opening in shelf 115 when the main body 110 is affixed to the bottle or container. The passage 116 provides the substance from the container or bottle to be dispensed by the dispensing orifice 132 of the dispensing and closure system 100.

An actuator 130 is provided, which has a push button member 120 arranged therein. The actuator 130 is configured to fit within the outer wall 112 of the main body 110 and to cover the open top section 111 of the main body 110. The actuator 130 includes an upper surface in the form of a disk 131, which covers the open section 111 of the main body 110, and is configured to pivot between an open and closed configuration. The actuator 130 also includes a wall 134 extending down from the upper surface and disk 131, which extends around the perimeter of the disk 131.

On one side of the actuator 130, below the upper surface 131, a dispensing orifice 132 is provided through the wall 134. When the closure and dispensing system 100 is in the closed position, the dispensing orifice 132 is arranged within the outer wall 112 of the main body 110, and cannot dispense any of the substance from the container. When the closure and dispensing system 100 is in the open position, the disk 131 of the actuator 130 has pivoted from the closed position, such that the dispensing orifice 132 is arranged above the outer wall 112 of the main body 110, and is exposed to dispense the substance from the container. The wall 134 of actuator 130 also includes two opposing projections 135 arranged thereon, upon which the actuator 130 pivots. The projections 135 can be rounded as shown in the Figures, or in alternative embodiments make take other forms such as a peg, extension or other structure which enables the pivoting of the actuator 130. The main body 110 includes two opposing dimples 118 or channels that are configured to receive the projections 135, upon which the actuator 130 can pivot, and also which aid in securing the actuator 130 to the main body 110.

On the side of the actuator 130 opposite the dispensing orifice 132, an actuating portion 133 is provided on the upper surface of the actuator 130, where the actuator 130 can be depressed by the user to pivot the actuator 130 from the closed position to the open position, thereby exposing the dispensing orifice 132. In the embodiments illustrated in the Figures, the actuating portion 133 of the actuator 130 may include markings or indicia, such as raised lettering allowing the actuating portion 133 to be identified by touch, but in other embodiments, the actuating portion 133 can have no marking or indicia, or may take the form of a tab or other extension off of the disk top 131. The actuator 130 is positioned in the main body 110 such that actuating portion 133 is arranged adjacent to the recess 113 in the outer wall 112 of the main body 110.

The wall 134 further comprises an opening 136 formed through the wall 134 opposite the dispensing orifice 132 and adjacent to the actuating portion 133. The wall opening 136 is shaped and dimensioned to receive a button projection 122 of the push button member 120. The push button member 120 comprises a ring 121 having a button projection 122 on one side of the ring 121 and a slot 123 on the ring 121 opposite the button projection 122. In the embodiments shown in the Figures, the wall opening 136 and the button projection 122 have a substantially square or rectangular shape, but in other embodiments, the shape may vary and can take any number of forms, such as triangular, circular, hexagonal or any other irregular or regular shape. The button projection 122 is configured to pass through the wall opening 136. In alternative embodiments, the button projection 122 may be utilized without the actuator including a wall 134 or opening 136. The underside of the disk 131 of the actuator includes an interior wall segment 138*a*, which includes a finger 138*b*. The finger 138*b* is configured to be received in the slot 123 of the push button member 120, to engage the push button member 120 with the actuator 130. The ring 121 of the push button member 120 is configured to bias the button projection 122 outwardly (i.e., away from the slot 123) but is made of a material having adequate pliability to allow the button projection to be pushed inwardly (i.e., toward the slot 123), flexing the ring into a more ovular shape. In other embodiments of the system 100, a biasing spring, such as a helical spring, can be provided in lieu of the ring 121.

The operation of the dispensing and closure system 100 will now be described. As shown in FIGS. 1A-1I, when the system 100 is in the closed configuration, the button projection 122 is disposed in the recess 113 in the outer wall 112 of the main body 110. The button projection 122 abuts the edge 114 of the recess 113, such that when the actuating portion 133 of the actuator 130 is depressed, the button projection 122 comes into direct contact with the edge 114 and blocks any downward movement of the actuating portion 133 of the actuator 130. As a result, the actuator 130 cannot pivot into the open configuration while the button projection 122 of the push button member 120 is projected outwardly through the wall opening 136 of the actuator 130. This effectively locks the system 100 in a closed configuration and prevents it from being opened by a simple depression of the actuator 130. The substance in a container to which the system 100 is connected cannot be dispensed in the closed configuration. To prevent leakage of any of the substance out of the dispensing orifice 132 when the system 100 is closed, the actuator comprises a sealing cap 137 that is configured to fit inside of the tubular passage 116 of the main body to prevent leakage of the substance from the bottle or container through the tubular passage 116 of the main body 110.

In order to unlock and open the dispensing system 100, the button projection 122 must be pushed inward while depressing the actuating portion 133 of the actuator 130. When the user presses the button projection 122 inward towards the center of the system 100, the push button member 120 remains engaged with the actuator 130 by way of the engagement of the interior wall segment 138*a* and slot 123, and the ring 121 flexes at the sides to allow the push button member 120 to be pushed through the wall opening 136, so that it is either flush with the wall 134 of the actuator 130 or within the wall 134. In this pushed-in position, the push button 122 is no longer in abutment with the edge 114 of the recess 113 of the outer wall 112 of the body member 110, and the push button 122 no longer obstructs downward movement of the actuating portion 133 by the user. The actuator 130 can therefore be pivoted into the open configuration, shown for example in FIGS. 2A-2I which exposes the dispensing orifice 132 and removes the cap 137 from the tubular passage 116 to allow dispensing of the substance from the container.

Because the push button 122 is biased outwardly, when it is released, it will have a tendency to extend itself back outwardly. As a result, the actions of the pushing in of the push button 122 and the depressing of the actuating portion 133 may require simultaneity by the user in order to open the system 100, thus making it more difficult for a child to open the system 100. When the system 100 is in the open configuration, the push button 122 remains biased outward, but is blocked from fully extending by abutting against an inner surface of the outer wall 112 of the main body 110.

Figure 2A:
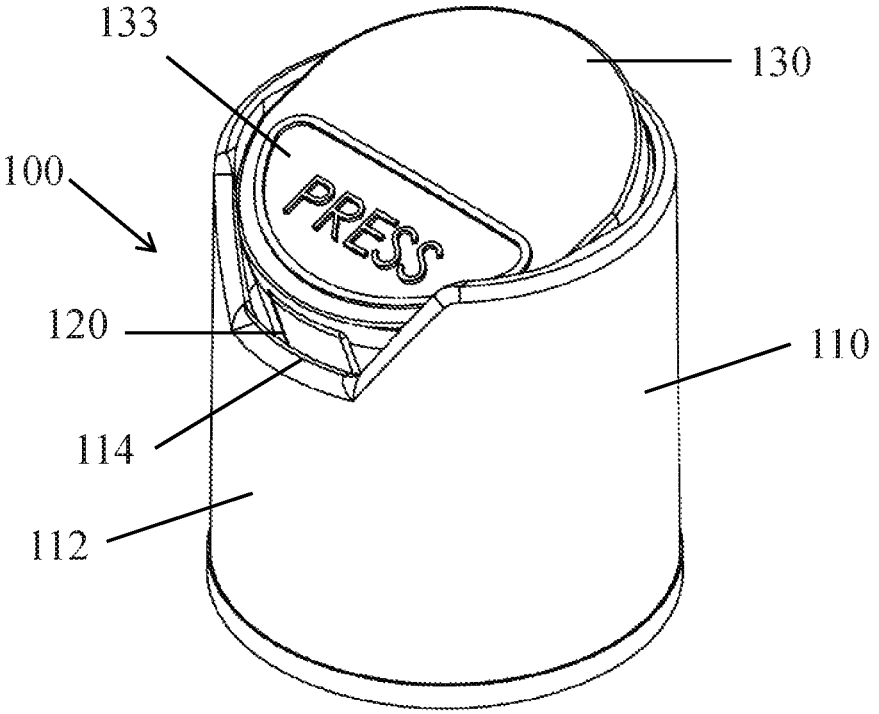
FIG. 2A shows a rear perspective view of a container closure and dispensing device in accordance with the first embodiment of the present application, in an unlocked and open configuration.
Figure 2B:
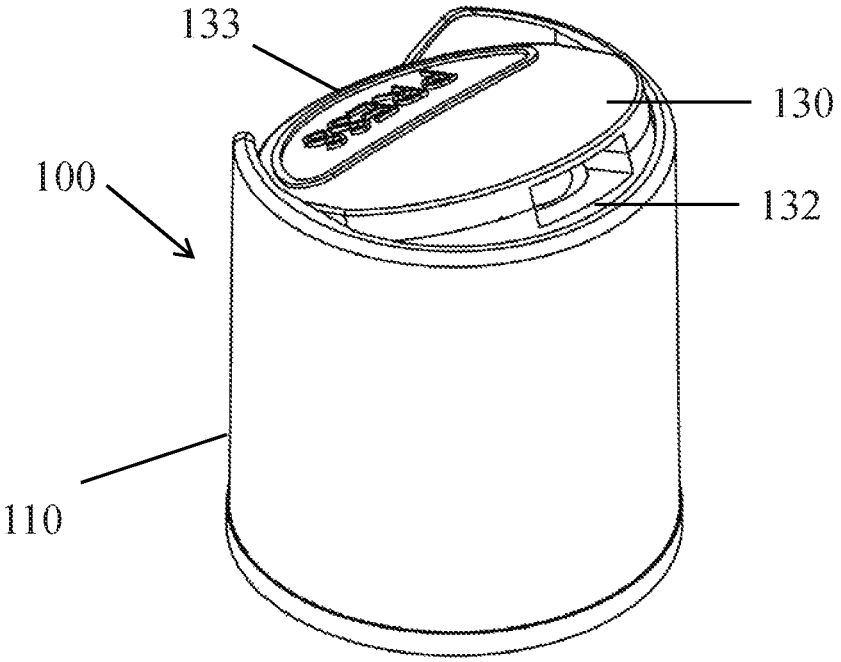
FIG. 2B shows a front perspective view of the container closure and dispensing device in accordance with the first embodiment of the present application, in an unlocked and open configuration.
Figure 2C:
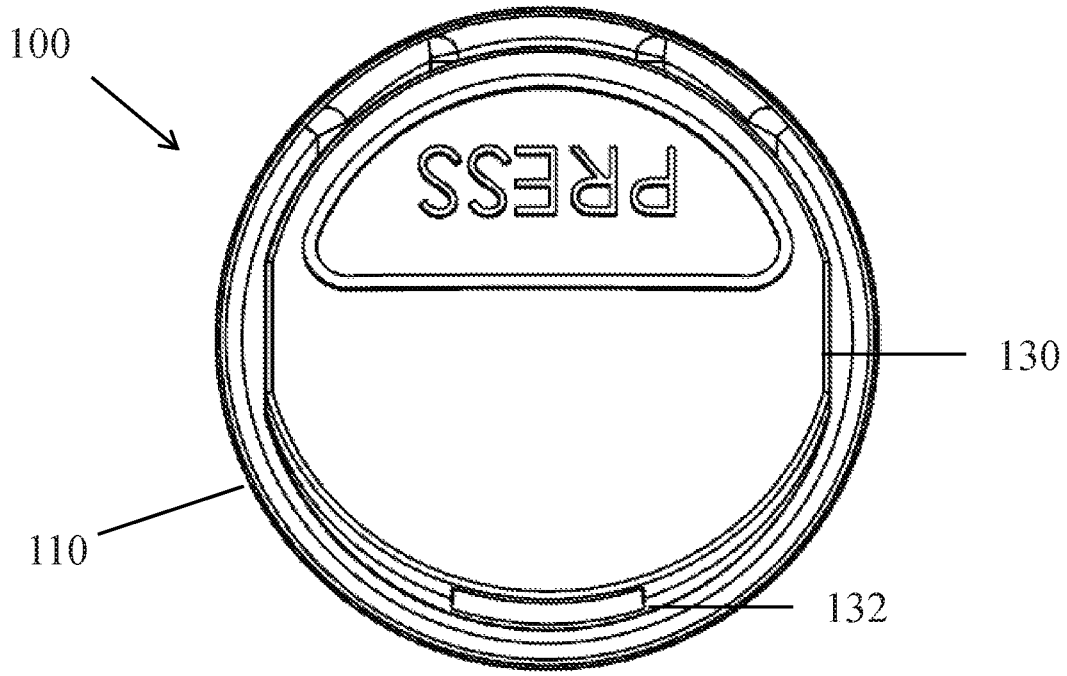
FIG. 2C shows a top view of the container closure and dispensing device in accordance with the first embodiment of the present application, in an unlocked and open configuration.
Figure 2D:
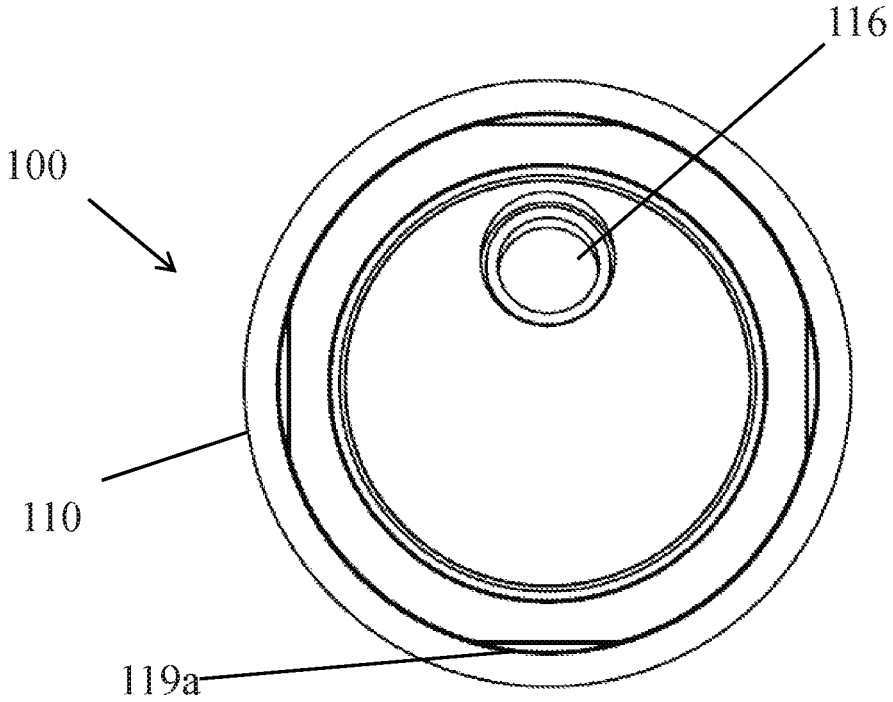
FIG. 2D shows a bottom view of the container closure and dispensing device in accordance with the first embodiment of the present application, in an unlocked and open configuration.
Figure 2E:
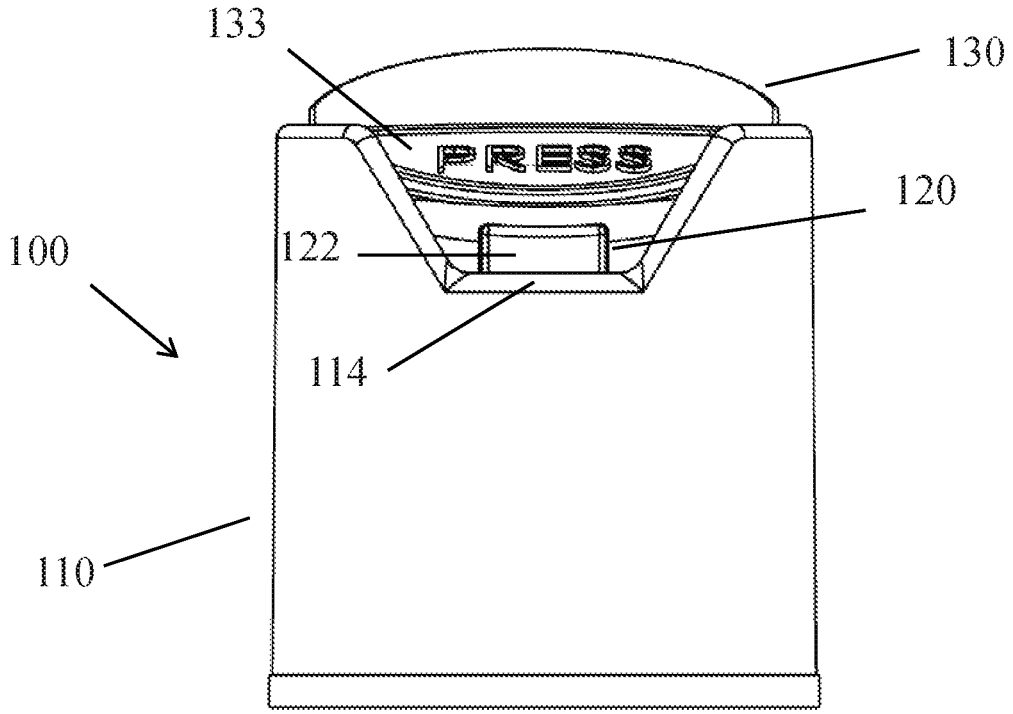
FIG. 2E shows a rear view of the container closure and dispensing device in accordance with the first embodiment of the present application, in an unlocked and open configuration.
Figure 2F:
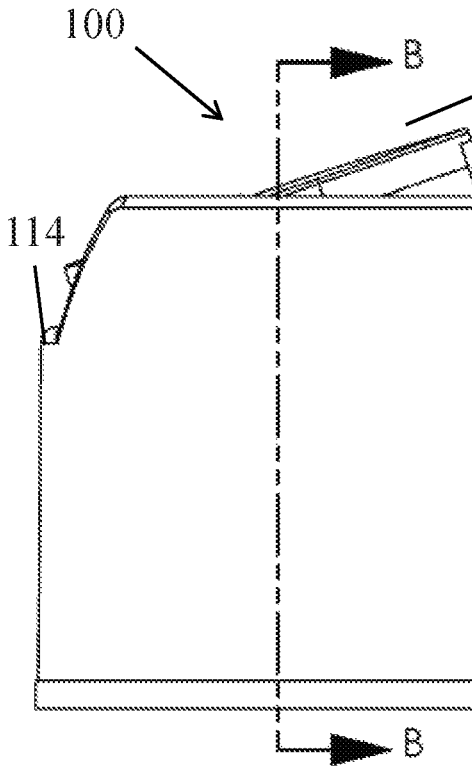
FIG. 2F shows a side view of the container closure and dispensing device in accordance with the first embodiment of the present application, in an unlocked and open configuration.
Figure 2G:
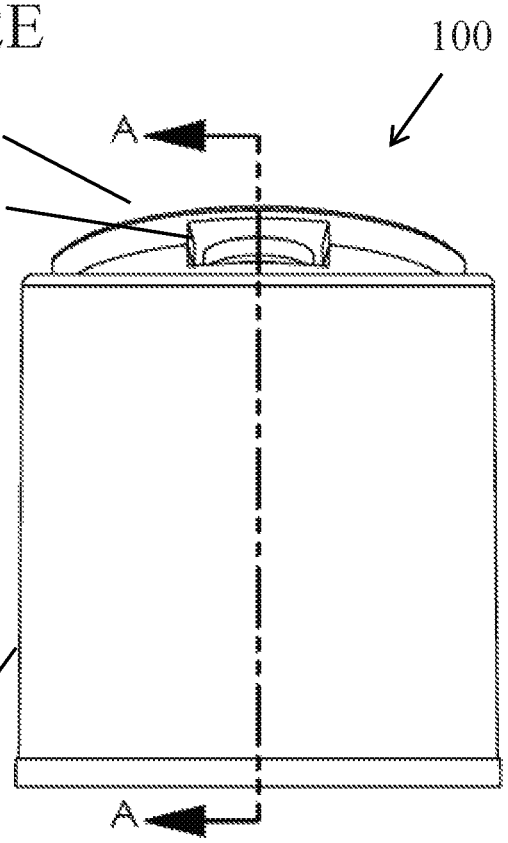
FIG. 2G shows a front view of the container closure and dispensing device in accordance with the first embodiment of the present application, in an unlocked and open configuration.
Figure 2H:
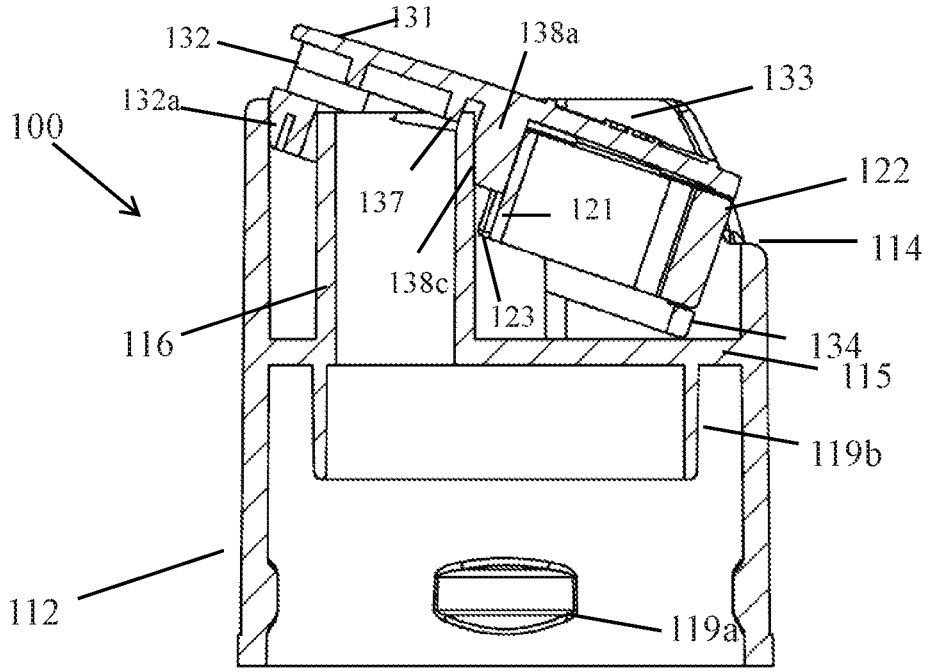
FIG. 2H shows a cross-sectional view of the container closure and dispensing device in accordance with the first embodiment of the present application, in an unlocked and open configuration, along axis A-A identified in FIG. 2G.
Figure 2I:
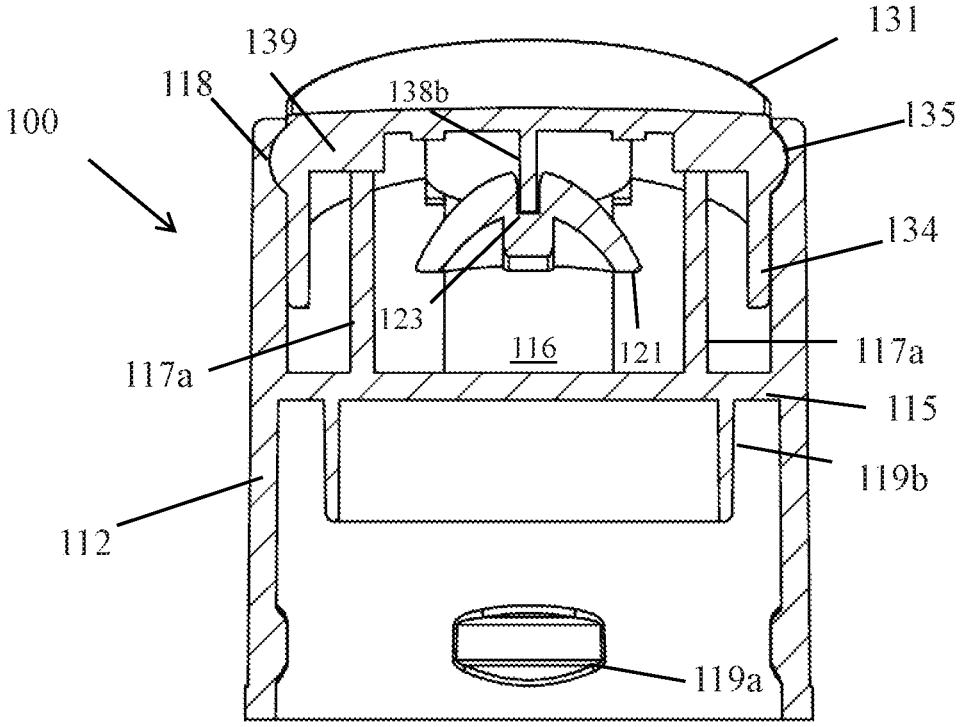
FIG. 2I shows a cross-sectional view of the container closure and dispensing device in accordance with the first embodiment of the present application, in an unlocked and open configuration, along axis B-B identified in FIG. 2F.
Figure 3A:
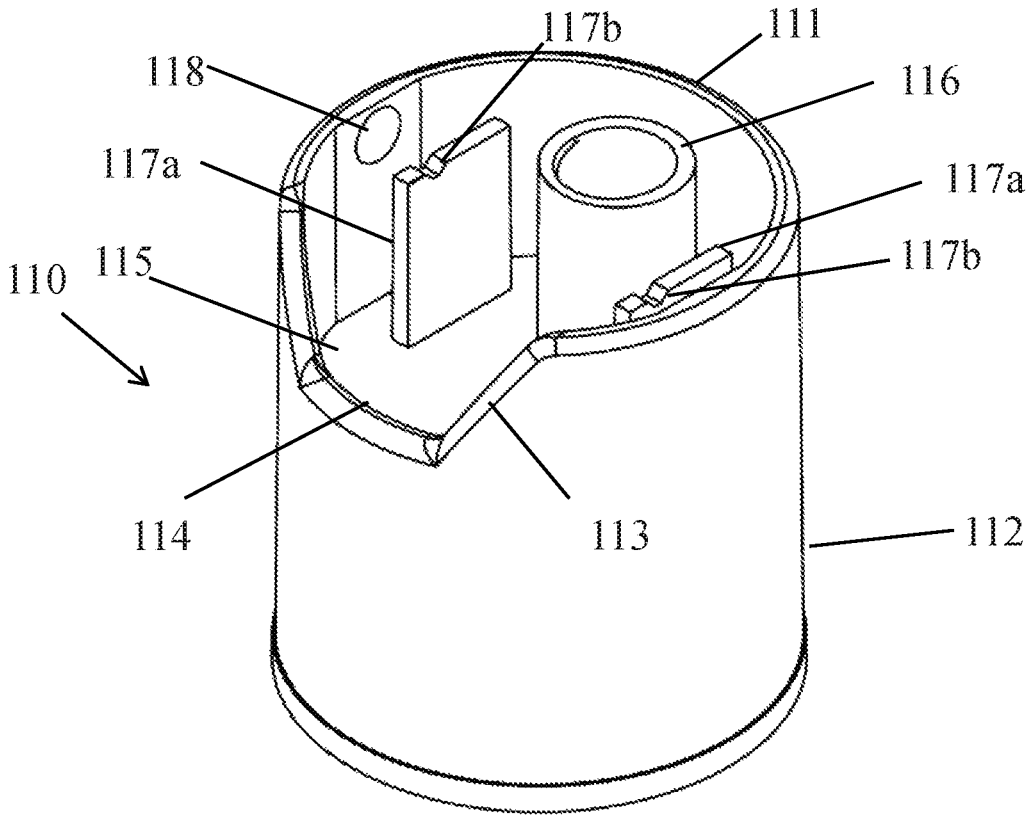
Figure 3B:
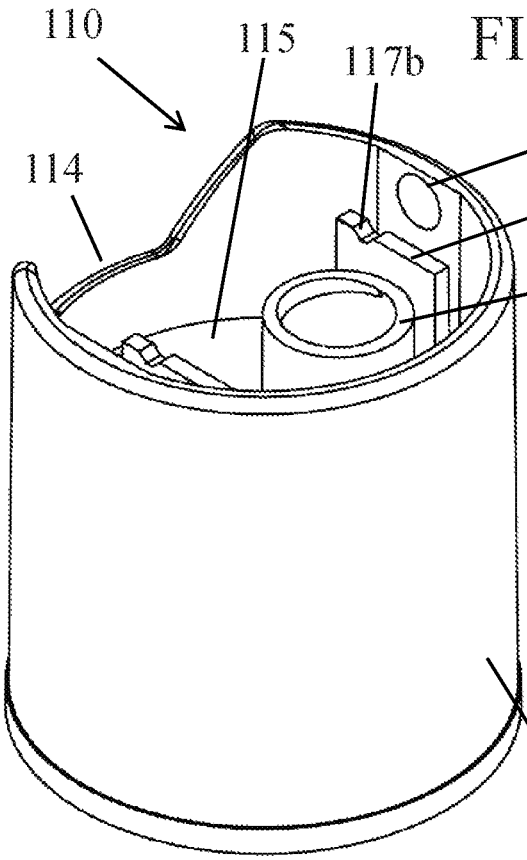
Figure 3C:
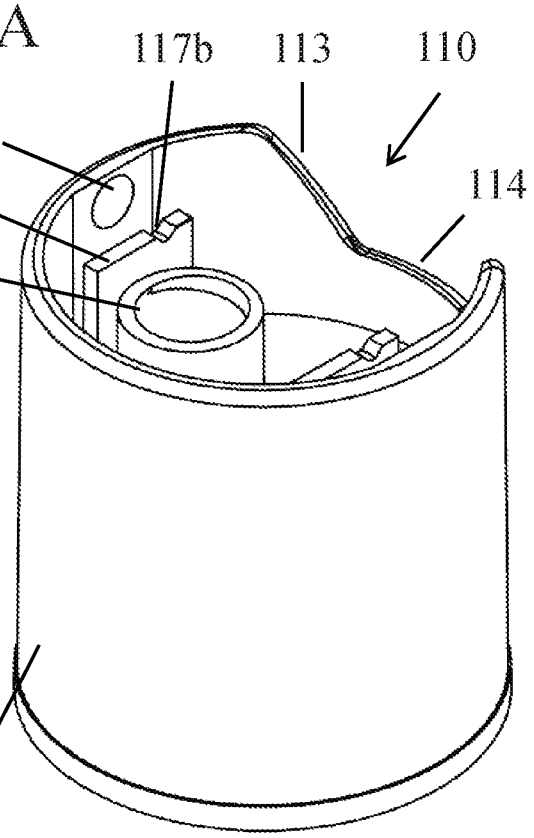
Figure 3H:
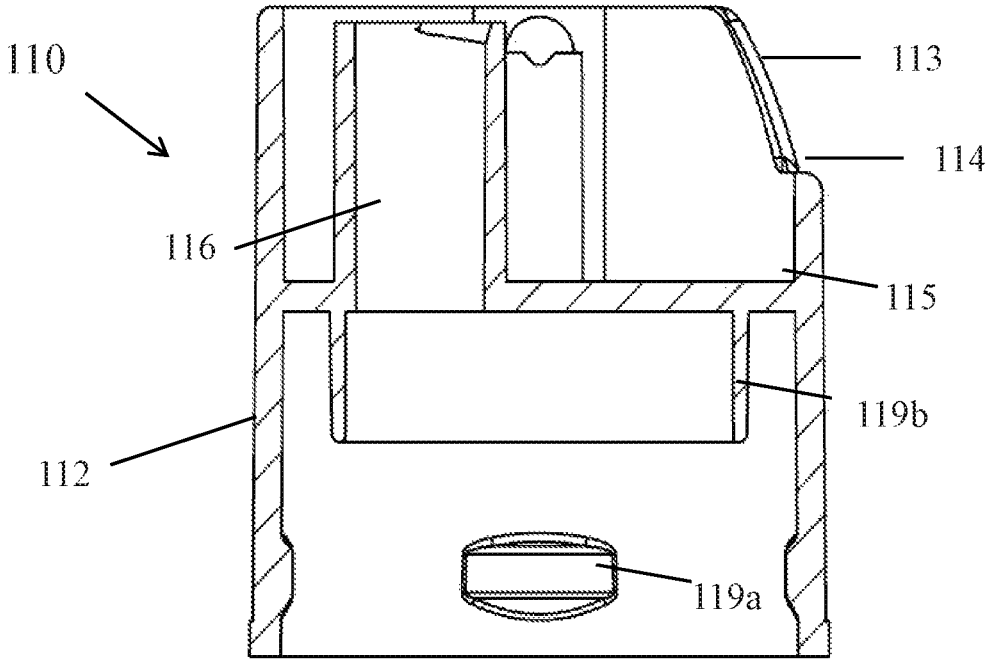
FIG. 3H shows a cross-sectional view of the container closure and dispensing device in accordance with the first embodiment of the present application, in an unlocked and open configuration, along axis A-A identified in FIG. 3F.
Figure 3I:
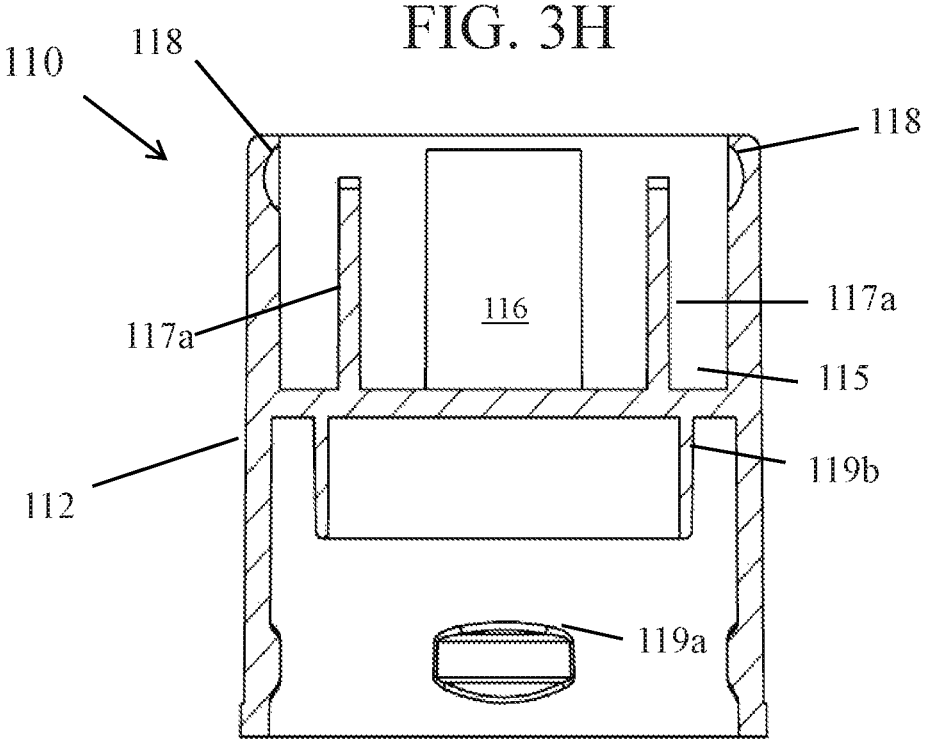
FIG. 3I shows a cross-sectional view of the container closure and dispensing device in accordance with the first embodiment of the present application, in an unlocked and open configuration, along axis B-B identified in FIG. 3G.
Figure 4A:
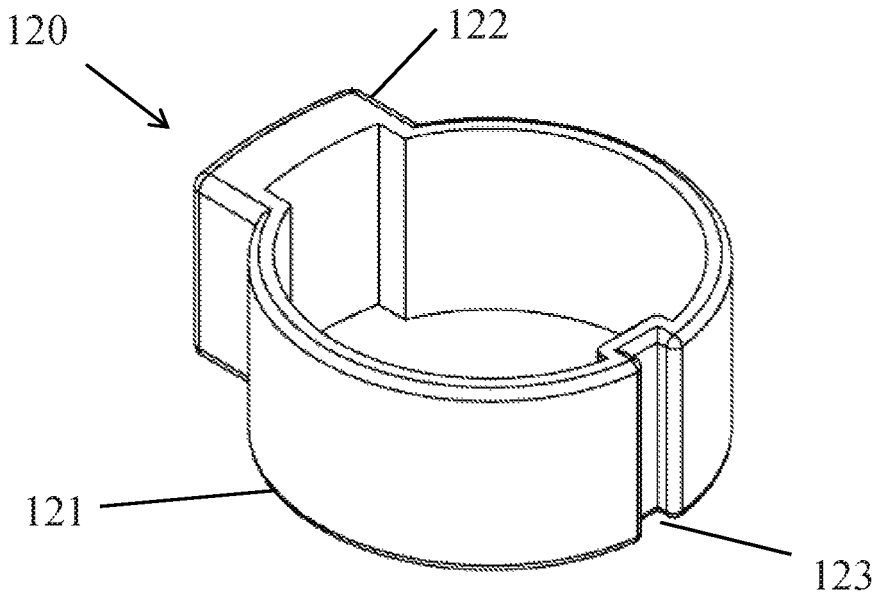
FIGS. 4A-4F show various views of a button of the container closure and dispensing device in accordance with the first embodiment of the present application.
Figure 4B:
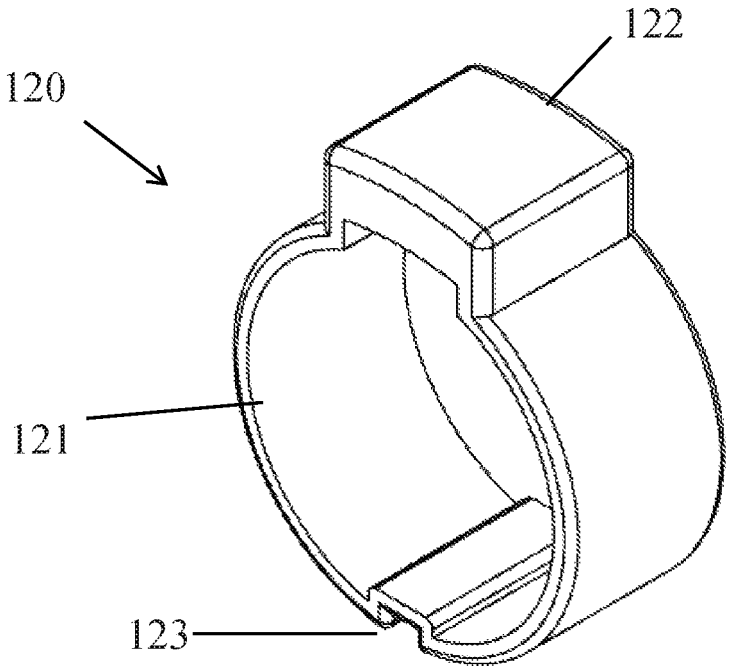
Figure 4C:
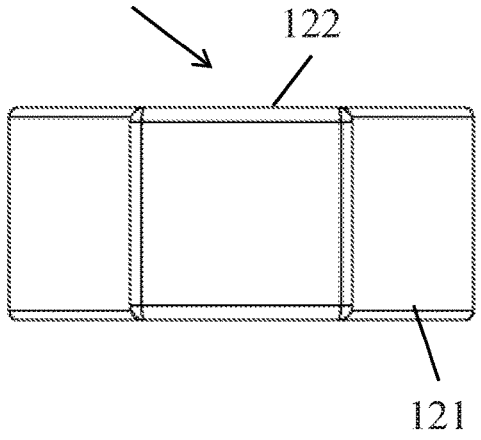
Figure 4D:
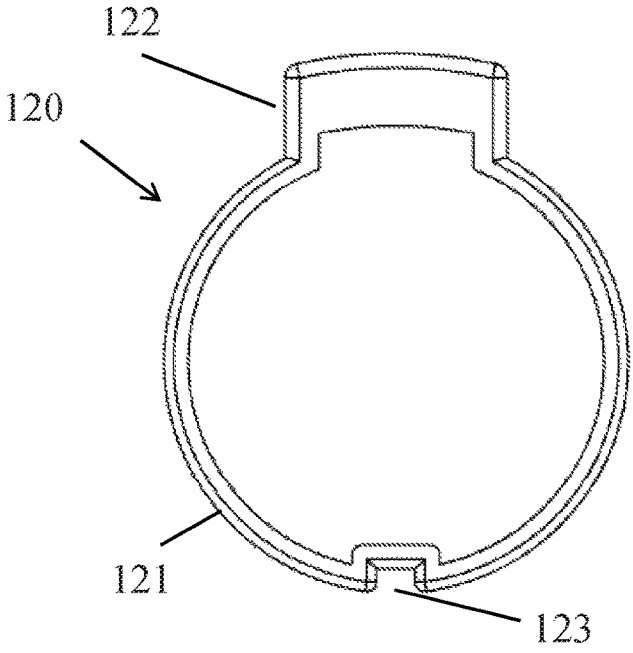
Figure 4E:
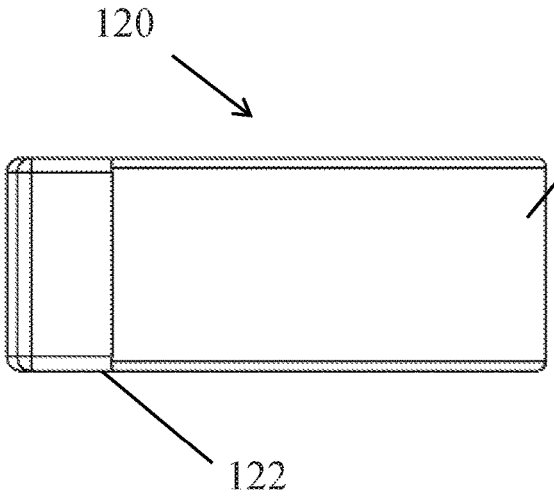
Figure 4F:
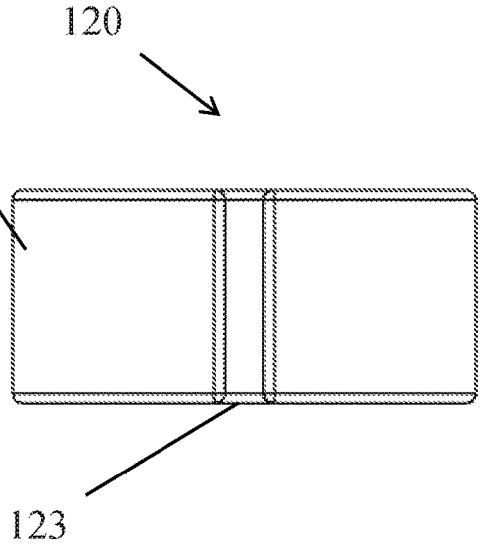
Figure 5A:
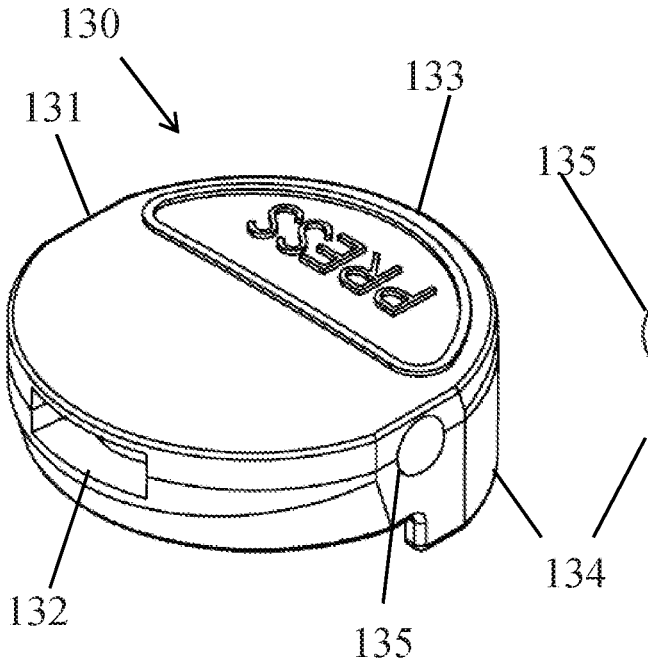
FIG. 5A shows a perspective view of an actuator of the container closure and dispensing device in accordance with the first embodiment of the present application.
Figure 5B:
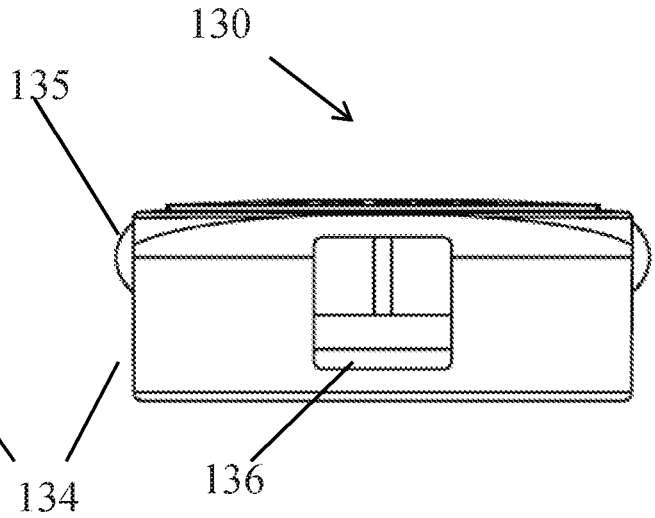
FIG. 5B shows a rear view of the actuator of the container closure and dispensing device in accordance with the first embodiment of the present application.
Figure 5C:
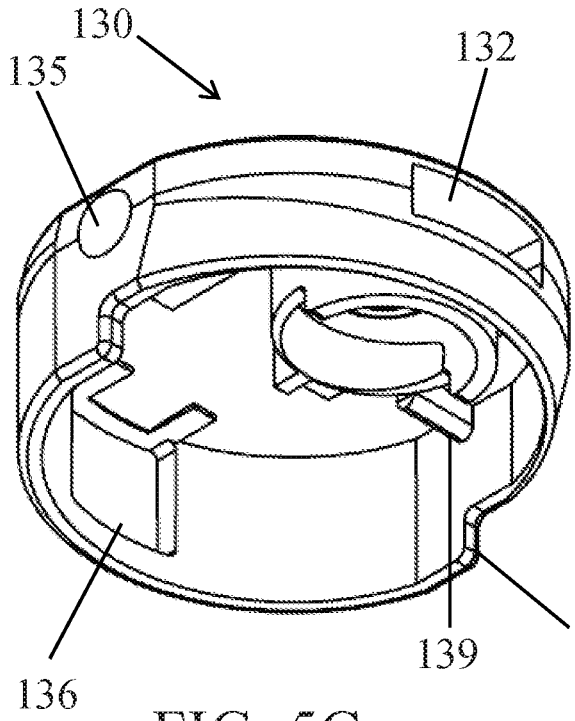
FIGS. 5C-5D show bottom perspective views of the actuator of the container closure and dispensing device in accordance with the first embodiment of the present application.
Figure 5D:
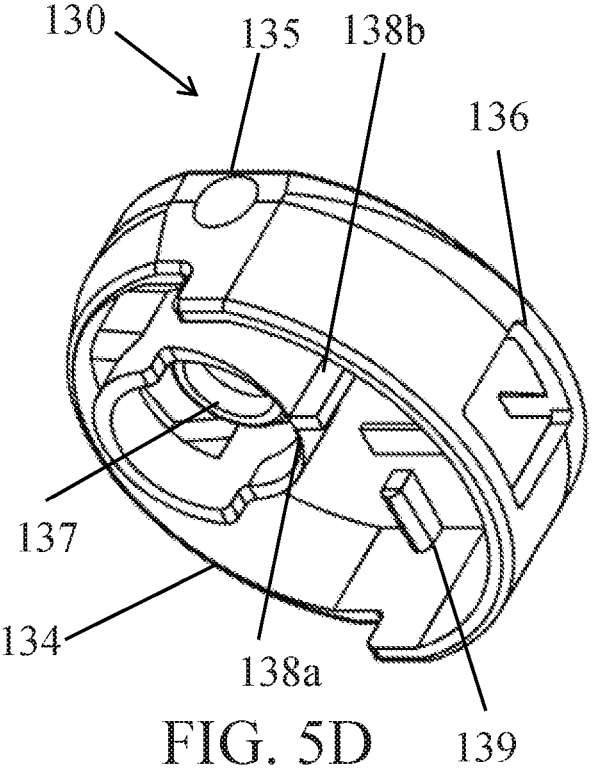
Figure 5E:
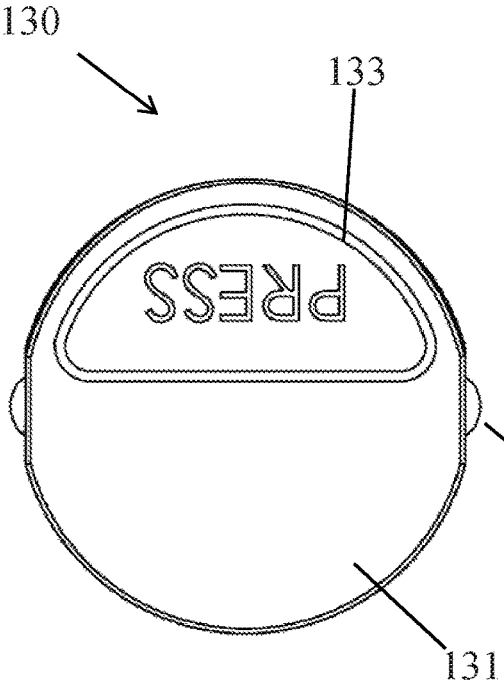
FIG. 5E shows a top view of an actuator of the container closure and dispensing device in accordance with the first embodiment of the present application.
Figure 5F:
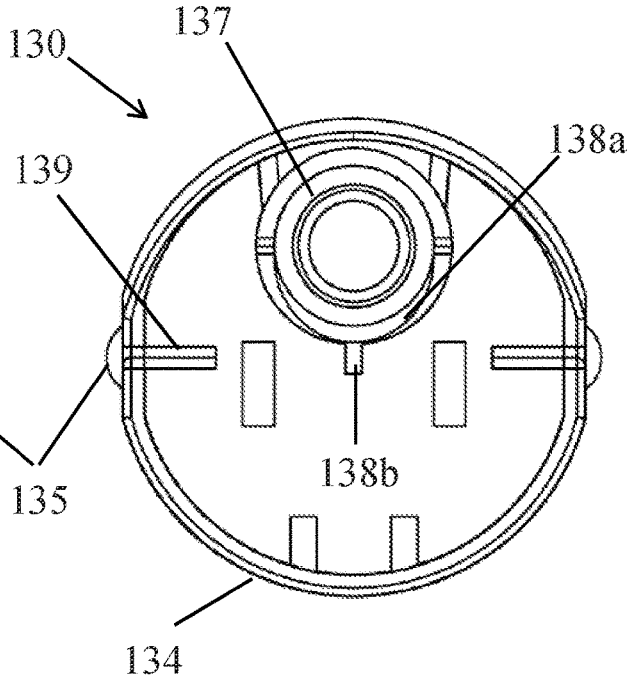
FIG. 5F shows a bottom view of the actuator of the container closure and dispensing device in accordance with the first embodiment of the present application.
Figure 5G:
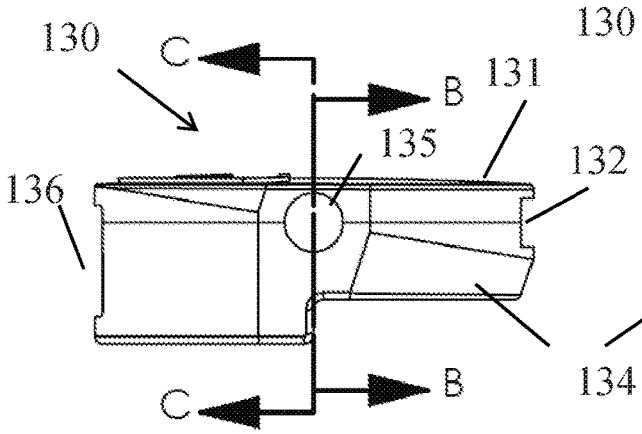
FIG. 5G shows a side view of an actuator of the container closure and dispensing device in accordance with the first embodiment of the present application.
Figure 5H:
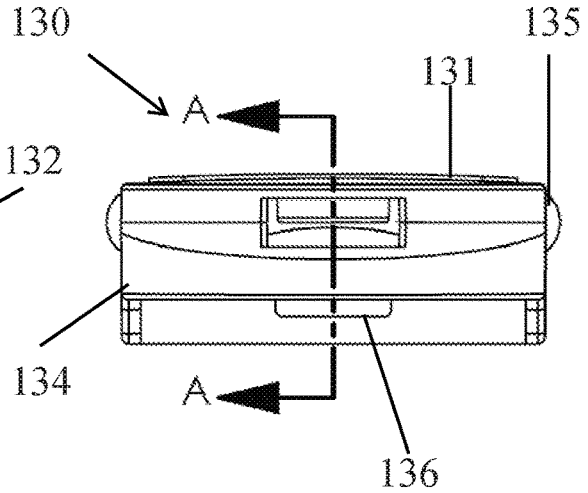
FIG. 5H shows a front view of the actuator of the container closure and dispensing device in accordance with the first embodiment of the present application.
Figure 5I:
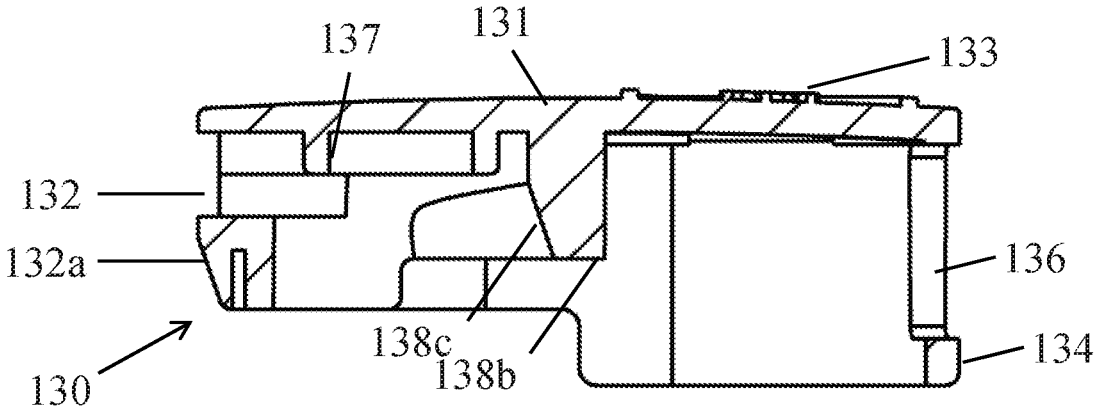
FIG. 5I shows a cross-sectional view of the actuator of the container closure and dispensing device in accordance with the first embodiment of the present application, along axis A-A identified in FIG. 5H.
Figure 5J:
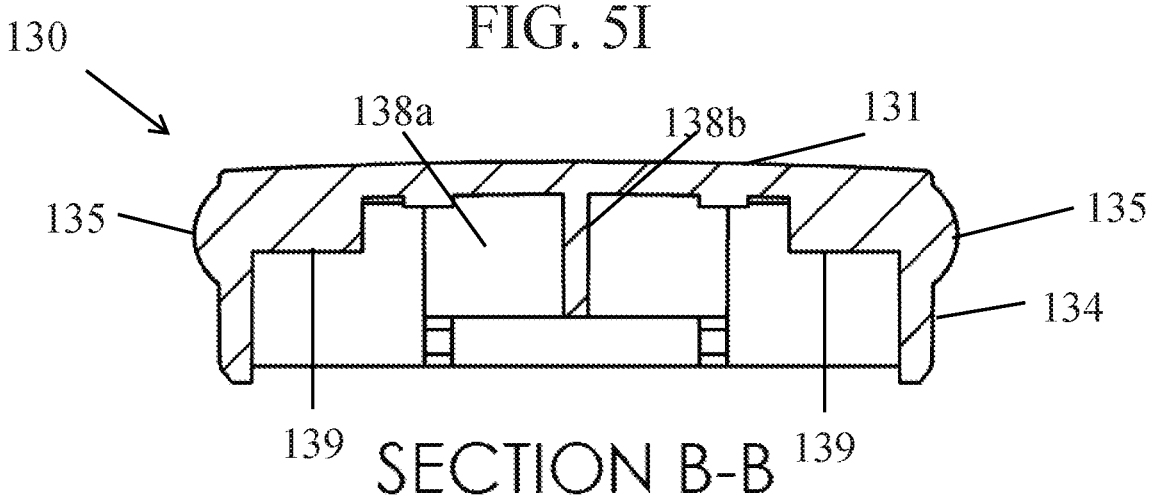
FIG. 5J shows a cross-sectional view of the actuator of the container closure and dispensing device in accordance with the first embodiment of the present application, along axis B-B identified in FIG. 5G.
Figure 5K:
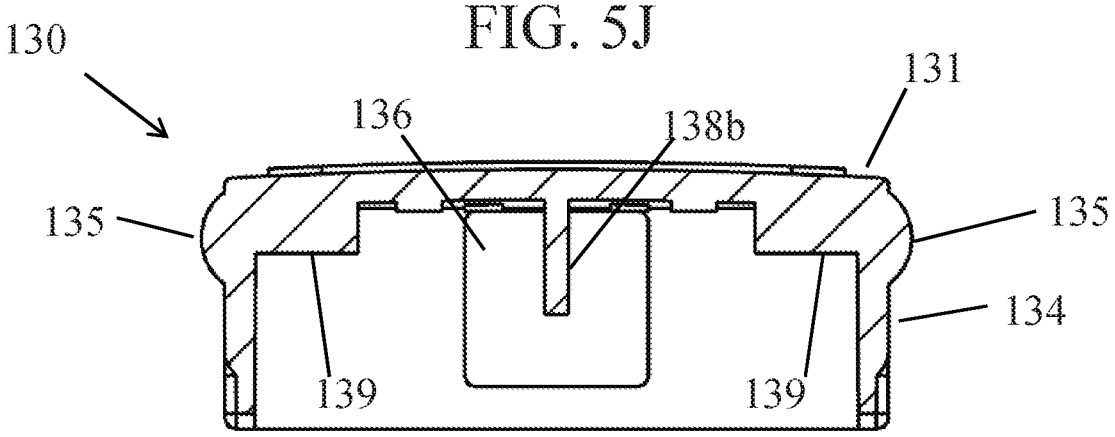
FIG. 5K shows a cross-sectional view of the actuator of the container closure and dispensing device in accordance with the first embodiment of the present application, along axis C-C identified in FIG. 5G.

So that the interior wall segment 138*a* of the actuator 130 does not interfere with the pivoting of the actuator 130, the interior wall segment 138*a* may include a beveled edge 138*c* opposite the finger 138*b*, which may come into contact with a portion of the passage 116 when the actuator 130 is pivoted into the open configuration, as shown for example in FIG. 2H. The dispensing orifice 132 may also include a beveled edge 132*a* for a similar purpose, which may come into contact with a portion of outer wall 112 of the main body 110 when the actuator 130 is pivoted into the open configuration, as shown for example in FIG. 2H. To further aid in the pivoting action of the actuator 130 with respect to the main body 110, the main body 110 may comprise one or more support members 117*a* on the shelf 115 that are configured to engage one or more wall members 139 on the under surface of the disk 131. The support members 117*a* may also comprise a notch 117*b* configured to receive the wall 139.

In order to return the system 100 from the open configuration to the closed configuration, the upper surface of the disk 131 of the actuator 130 can be depressed at the dispensing orifice 132 and opposite the actuating portion 133, to push the dispensing orifice 132 back into a position where it is concealed by the outer wall 112 of the main body 110. As the push button 122 is outwardly biased, once the push button 122 is raised above the edge 114 of the wall 112 of the main body 110, it can fully extend out through the wall opening 136 of the actuator 130 and the system 100 is relocked into the closed configuration.

As used herein, directional or positional terms such as "front", "rear", "upper", "lower", "top", "bottom", etc., are used for explanatory purposes only to describe the closure system 100 as illustrated in the figures, with the dispensing side of the system 100 being designated the "front" for explanatory purposes.

While there have been shown and described and pointed out fundamental novel features of the invention as applied to embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed:

1. A closure system for a dispensing container, comprising:

a body member comprising:

an outer circumferential wall comprising a recess in the wall; and an actuator comprising:

a dispensing orifice;

a disk top comprising an actuating portion configured to be depressed to pivot the disk top between an open configuration providing access to the dispensing orifice and a closed configuration concealing the dispensing orifice;

an actuator wall extending from and around the perimeter of the disk top having the dispensing orifice formed through a first section of the actuator wall and a wall opening formed through a second section of the actuator wall, the wall opening arranged adjacent to the actuating portion; and a push button member arranged within the actuator wall comprising a projecting button biased outwardly through the wall opening;

wherein in the closed configuration, the projecting button abuts an edge of the recess of the outer circumferential wall of the body member, which prevents depression of the actuating portion and pivoting of the disk top into the open configuration;

wherein the projecting button is configured to be pushed inwardly through the wall opening to position the projecting button out of abutment with the edge of the recess to enable depression of the actuating portion and pivoting of the disk top into the open configuration.

2. The closure system of claim 1, wherein in the open configuration, a portion of the disk top opposite the actuating portion can be depressed to pivot the disk top from the open configuration into the closed configuration, and wherein in the open configuration, the outwardly biased projecting button is retained within the outer circumferential wall of the body member, and pivoting the disk top from the open configuration into the closed configuration enables the outwardly biased projecting button to extend back through the wall opening into abutment with the edge of the recess of the outer circumferential wall of the body member.

3. The closure system of claim 1, wherein the body member further comprises two opposing dimples on an inner surface of the outer circumferential wall configured to engage projecting members of the actuator to secure the actuator to the body member in a manner that permits the pivoting of the actuator.

4. The closure system of claim 1, wherein the outer circumferential wall is configured to conceal the dispensing orifice in the closed configuration.

5. The closure system of claim 1, wherein the body member comprises a tubular passageway projecting from a shelf within the body member configured to deliver a substance to the dispensing orifice.

6. The closure system of claim 5, wherein the actuator further comprises a sealing member configured to engage the tubular passageway of the body member in the closed configuration to seal the tubular passageway from the dispensing orifice.

7. The closure system of claim 1, wherein the body member comprises a base section configured to be connected to a bottle or a container.

8. The closure system of claim 1, wherein the push button member comprises a spring configured to bias the projecting button outwardly through the wall opening and engaging the actuator at a side of the spring opposite the projecting button.

9. The closure system of claim 8, wherein the spring of the push button member is a flexible ring comprising the push button on one side and a slot on another side opposite the push button.

10. The closure system of claim 9, wherein the actuator further comprises a wall segment within the actuator wall comprising a finger configured to be received in the slot of the push button member to engage the push button member to the actuator.

11. The closure system of claim 10, wherein the wall segment of the actuator comprises a beveled edge adjacent to a tubular passageway within the body member.

12. The closure system of claim 1, wherein the actuating portion comprises raised indicia identifying the actuating portion.

13. The closure system of claim 1, wherein the first section of the actuator wall comprising the dispensing orifice is arranged opposite the second section of the actuator wall comprising the wall opening.

14. The closure system of claim 1, wherein pivoting of the disk top into the open configuration comprises simultaneously pushing inwardly the projecting to position the projecting button out of abutment with the edge of the recess and depressing the actuating portion of the disk top.

15. A closure system for a dispensing container, comprising:

a body member comprising:

an outer circumferential wall comprising a recess in the wall; and an actuator comprising:

a dispensing orifice;

a disk top comprising an actuating portion configured to be depressed to pivot the disk top between an open configuration providing access to the dispensing orifice and a closed configuration concealing the dispensing orifice; and a push button member comprising a projecting button biased outwardly into the recess of the outer circumferential wall of the body member and arranged adjacent to the actuating portion of the disk top;

wherein in the closed configuration, the projecting button abuts an edge of the recess of the outer circumferential wall of the body member, which prevents depression of the actuating portion and pivoting of the disk top into the open configuration;

wherein the projecting button is configured to be pushed inwardly to position the projecting button out of abutment with the edge of the recess to enable depression of the actuating portion and pivoting of the disk top into the open configuration.

16. The closure system of claim 15, wherein in the open configuration, a portion of the disk top opposite the actuating portion can be depressed to pivot the disk top from the open configuration into the closed configuration, and wherein in the open configuration, the outwardly biased projecting button is retained within the outer circumferential wall of the body member, and pivoting the disk top from the open configuration into the closed configuration enables the outwardly biased projecting button to extend back into abutment with the edge of the recess of the outer circumferential wall of the body member.

17. The closure system of claim 15, wherein the push button member comprises a spring configured to bias the projecting button outwardly and engaging the actuator at a side of the spring opposite the projecting button.

18. A system comprising:

a container for dispensing a substance; and a closure system for the container, comprising:

a body member comprising:

an outer circumferential wall comprising a recess in the wall; and an actuator comprising:

a dispensing orifice;

a disk top comprising an actuating portion configured to be depressed to pivot the disk top between an open configuration providing access to the dispensing orifice and a closed configuration concealing the dispensing orifice;

an actuator wall extending from and around the perimeter of the disk top having the dispensing orifice formed through a first section of the actuator wall and a wall opening formed through a second section of the actuator wall, the wall opening arranged adjacent to the actuating portion; and a push button member arranged within the actuator wall comprising a projecting button biased outwardly through the wall opening;

wherein in the closed configuration, the projecting button abuts an edge of the recess of the outer circumferential wall of the body member, which prevents depression of the actuating portion and pivoting of the disk top into the open configuration;

wherein the projecting button is configured to be pushed inwardly through the wall opening to position the projecting button out of abutment with the edge of the recess to enable depression of the actuating portion and pivoting of the disk top into the open configuration.

19. The system of claim 18, wherein the body member comprises a base section configured to be connected the container.

20. The system of claim 19, wherein the body member comprises an annular seal configured to be received in a neck of the container to seal the container and direct the substance of the container into a tubular passageway configured to deliver the substance to the dispensing orifice.

* * * * *